US011713625B2

(12) United States Patent
Eitschberger

(10) Patent No.: US 11,713,625 B2
(45) Date of Patent: Aug. 1, 2023

(54) BULKHEAD

(71) Applicant: DynaEnergetics Europe GmbH, Troisdorf (DE)

(72) Inventor: Christian Eitschberger, Munich (DE)

(73) Assignee: DynaEnergetics Europe GmbH

( * ) Notice: Subject to any disclaimer, the term of this patent is extended or adjusted under 35 U.S.C. 154(b) by 0 days.

(21) Appl. No.: 17/677,478

(22) Filed: Feb. 22, 2022

(65) Prior Publication Data

US 2022/0282578 A1 Sep. 8, 2022

Related U.S. Application Data

(60) Provisional application No. 63/155,902, filed on Mar. 3, 2021.

(51) Int. Cl.
*E21B 43/1185* (2006.01)
*E21B 17/02* (2006.01)
*E21B 33/10* (2006.01)

(52) U.S. Cl.
CPC ..... *E21B 17/028* (2013.01); *E21B 33/10* (2013.01)

(58) Field of Classification Search
CPC .... E21B 17/028; E21B 33/10; E21B 43/1185; E21B 43/116
See application file for complete search history.

(56) References Cited

U.S. PATENT DOCUMENTS 2,216,359 A 10/1940 Spencer
2,228,873 A 1/1941 Hardt et al.
2,296,346 A 9/1942 Hearn
2,326,406 A 8/1943 Lloyd
2,358,466 A 9/1944 Miller
2,418,486 A 4/1947 Smylie
2,439,394 A 4/1948 Lanzalotti et al.
2,519,116 A 8/1950 Crake
2,543,814 A 3/1951 Thompson et al.
(Continued)

FOREIGN PATENT DOCUMENTS

AU 2010217183 B2 6/2016
CA 2003166 A1 5/1991
(Continued)

OTHER PUBLICATIONS

G&H Diversified Manufacturing, LP; Plaintiff and Counterclaim Defendant G&H Diversified Manufacturing, LP and Counterclaim Defendant Yellow Jacket Oil Tools, LLC's First Supplemental Proposed Constructions; dated Jun. 24, 2021; 7 pages.
(Continued)

*Primary Examiner* — Taras P Bemko
(74) *Attorney, Agent, or Firm* — Womble Bond Dickinson (US) LLP

(57) ABSTRACT

A bulkhead may include a fixed body having an exterior fixed body surface, a first cover having a first large region and a first small region, a second cover having a second large region and a second small region, a seal element, a first electrical contact, and a second electrical contact. The exterior fixed body surface may be perpendicular to a radius of the fixed body. The seal element may contact the exterior fixed body surface in a gap provided between the first cover and the second cover. The first electrical contact may extend through the first small region of the first cover. The second electrical contact may extend through the second small region of the second cover.

19 Claims, 10 Drawing Sheets

(56) References Cited

U.S. PATENT DOCUMENTS 2,598,651 A 5/1952 Spencer
2,655,993 A 10/1953 Lloyd
2,696,258 A 12/1954 Greene
2,734,456 A 2/1956 Sweetman
2,785,631 A 3/1957 Blanchard
2,821,136 A 1/1958 Castel
2,889,775 A 6/1959 Owen
2,906,339 A 9/1959 Griffin
2,946,283 A 7/1960 Udry
2,982,210 A 5/1961 Andrew et al.
3,040,659 A 6/1962 Mcculleugh
RE25,407 E 6/1963 Lebourg
3,125,024 A 3/1964 Hicks et al.
3,155,164 A 11/1964 Keener
3,158,680 A 11/1964 Levitt et al.
3,170,400 A 2/1965 Nelson
3,173,992 A 3/1965 Boop
RE25,846 E 8/1965 Campbell
3,246,707 A 4/1966 Bell
3,264,989 A 8/1966 Rucker
3,264,994 A 8/1966 Kurt
3,336,054 A 8/1967 Blount et al.
3,374,735 A 3/1968 Moore
3,426,849 A 2/1969 Brumble, Jr.
3,426,850 A 2/1969 Mcduffie, Jr.
3,504,723 A 4/1970 Cushman et al.
3,565,188 A 2/1971 Hakala
3,859,921 A 1/1975 Stephenson
4,007,790 A 2/1977 Henning
4,007,796 A 2/1977 Boop
4,039,239 A 8/1977 Cobaugh et al.
4,058,061 A 11/1977 Mansur, Jr. et al.
4,100,978 A 7/1978 Boop
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,208,966 A 6/1980 Hart
4,220,087 A 9/1980 Posson
4,234,768 A 11/1980 Boop
4,266,613 A 5/1981 Boop
4,290,486 A 9/1981 Regalbuto
4,312,273 A 1/1982 Camp
4,363,529 A 12/1982 Loose
4,411,491 A 10/1983 Larkin et al.
4,457,383 A 7/1984 Boop
4,485,741 A 12/1984 Moore et al.
4,491,185 A 1/1985 McClure
4,496,008 A 1/1985 Pottier et al.
4,512,418 A 4/1985 Regalbuto et al.
4,523,649 A 6/1985 Stout
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,621,396 A 11/1986 Walker et al.
4,629,001 A 12/1986 Miller et al.
4,643,097 A 2/1987 Chawla et al.
4,650,009 A 3/1987 McClure et al.
4,657,089 A 4/1987 Stout
4,660,910 A 4/1987 Sharp et al.
4,730,793 A 3/1988 Thurber, Jr. et al.
4,744,424 A 5/1988 Lendermon et al.
4,747,201 A 5/1988 Donovan et al.
4,753,170 A 6/1988 Regalbuto et al.
4,762,067 A 8/1988 Barker et al.
4,776,393 A 10/1988 Forehand et al.
4,790,383 A 12/1988 Savage et al.
4,796,708 A 1/1989 Lembcke
4,800,815 A 1/1989 Appledorn et al.
4,852,494 A 8/1989 Williams
4,869,171 A 9/1989 Abouav
4,889,183 A 12/1989 Sommers et al.
5,006,833 A 4/1991 Marlowe et al.
5,027,708 A 7/1991 Gonzalez et al.
5,033,553 A 7/1991 Miszewski et al.
5,038,682 A 8/1991 Marsden
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,204,491 A 4/1993 Aureal et al.
5,237,136 A 8/1993 Langston
5,241,891 A 9/1993 Hayes et al.
5,322,019 A 6/1994 Hyland
5,334,801 A 8/1994 Mohn
5,347,929 A 9/1994 Lerche et al.
5,358,418 A 10/1994 Carmichael
5,392,851 A 2/1995 Arend
5,392,860 A 2/1995 Ross
5,436,791 A 7/1995 Turano et al.
5,503,077 A 4/1996 Motley
5,603,384 A 2/1997 Bethel et al.
5,648,635 A 7/1997 Lussier et al.
5,671,899 A 9/1997 Nicholas et al.
5,703,319 A 12/1997 Fritz et al.
5,756,926 A 5/1998 Bonbrake et al.
5,775,426 A 7/1998 Snider et al.
5,778,979 A 7/1998 Burleson et al.
5,785,130 A 7/1998 Wesson et al.
5,791,914 A 8/1998 Loranger et al.
5,803,175 A 9/1998 Myers, Jr. et al.
5,816,343 A 10/1998 Markel et al.
5,820,402 A 10/1998 Chiacchio et al.
5,823,266 A 10/1998 Burleson et al.
5,837,925 A 11/1998 Nice
5,911,277 A 6/1999 Hromas et al.
5,964,294 A 10/1999 Edwards et al.
5,992,289 A 11/1999 George et al.
6,006,833 A 12/1999 Burleson et al.
6,012,525 A 1/2000 Burleson et al.
6,112,666 A 9/2000 Murray et al.
6,263,283 B1 7/2001 Snider et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,354,374 B1 3/2002 Edwards et al.
6,385,031 B1 5/2002 Lerche et al.
6,386,108 B1 5/2002 Brooks et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,464,511 B1 10/2002 Watanabe et al.
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,506,083 B1 1/2003 Bickford et al.
6,582,251 B1 6/2003 Burke et al.
6,595,290 B2 7/2003 George et al.
6,618,237 B2 9/2003 Eddy et al.
6,651,747 B2 11/2003 Chen et al.
6,659,180 B2 12/2003 Moss
6,675,896 B2 1/2004 George
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,776,668 B1 8/2004 Scyoc et al.
6,779,605 B2 8/2004 Jackson
6,822,542 B2 11/2004 Clark et al.
6,843,317 B2 1/2005 Mackenzie
6,851,471 B2 2/2005 Barlow et al.

(56) References Cited

U.S. PATENT DOCUMENTS

| | | | |
|---|---|---|---|
| 6,902,414 | B2 | 6/2005 | Dopf et al. |
| 7,013,977 | B2 | 3/2006 | Nordaas |
| 7,044,230 | B2 | 5/2006 | Starr et al. |
| 7,074,064 | B2 | 7/2006 | Wallace |
| 7,093,664 | B2 | 8/2006 | Todd et al. |
| 7,107,908 | B2 | 9/2006 | Forman et al. |
| 7,114,564 | B2 | 10/2006 | Parrott et al. |
| 7,147,068 | B2 | 12/2006 | Vail, III |
| 7,168,494 | B2 | 1/2007 | Starr et al. |
| 7,182,625 | B2 | 2/2007 | Machado et al. |
| 7,193,156 | B2 | 3/2007 | Alznauer et al. |
| 7,193,527 | B2 | 3/2007 | Hall |
| 7,210,524 | B2 | 5/2007 | Sloan et al. |
| 7,237,626 | B2 | 7/2007 | Gurjar et al. |
| 7,243,722 | B2 | 7/2007 | Oosterling et al. |
| 7,278,491 | B2 | 10/2007 | Scott |
| 7,297,004 | B1 | 11/2007 | Shuhart et al. |
| 7,306,038 | B2 | 12/2007 | Challacombe |
| 7,347,278 | B2 | 3/2008 | Lerche et al. |
| 7,347,279 | B2 | 3/2008 | Li et al. |
| 7,350,448 | B2 | 4/2008 | Bell et al. |
| 7,353,879 | B2 | 4/2008 | Todd et al. |
| 7,357,083 | B2 | 4/2008 | Takahara et al. |
| 7,360,487 | B2 | 4/2008 | Myers, Jr. et al. |
| 7,364,451 | B2 | 4/2008 | Ring et al. |
| 7,387,162 | B2 | 6/2008 | Mooney, Jr. et al. |
| 7,404,725 | B2 | 7/2008 | Hall et al. |
| 7,441,601 | B2 | 10/2008 | George et al. |
| 7,473,104 | B1 | 1/2009 | Wertz |
| 7,476,132 | B2 | 1/2009 | Xu |
| 7,493,945 | B2 | 2/2009 | Doane et al. |
| 7,510,017 | B2 | 3/2009 | Howell et al. |
| 7,540,758 | B2 | 6/2009 | Ho |
| 7,544,102 | B2 | 6/2009 | Oda |
| 7,565,927 | B2 | 7/2009 | Gerez et al. |
| 7,568,429 | B2 | 8/2009 | Hummel et al. |
| 7,591,212 | B2 | 9/2009 | Myers, Jr. et al. |
| 7,690,925 | B2 | 4/2010 | Goodman |
| 7,726,396 | B2 | 6/2010 | Briquet et al. |
| 7,735,578 | B2 | 6/2010 | Loehr et al. |
| 7,752,971 | B2 | 7/2010 | Loehr |
| 7,762,172 | B2 | 7/2010 | Li et al. |
| 7,762,331 | B2 | 7/2010 | Goodman et al. |
| 7,762,351 | B2 | 7/2010 | Vidal |
| 7,775,279 | B2 | 8/2010 | Marya et al. |
| 7,778,006 | B2 | 8/2010 | Stewart et al. |
| 7,789,153 | B2 | 9/2010 | Prinz et al. |
| 7,810,430 | B2 | 10/2010 | Chan et al. |
| 7,815,440 | B2 | 10/2010 | Hsieh et al. |
| 7,901,247 | B2 | 3/2011 | Ring |
| 7,908,970 | B1 | 3/2011 | Jakaboski et al. |
| 7,929,270 | B2 | 4/2011 | Hummel et al. |
| 7,934,453 | B2 | 5/2011 | Moore |
| 7,980,874 | B2 | 7/2011 | Finke et al. |
| 8,028,624 | B2 | 10/2011 | Mattson |
| 8,066,083 | B2 | 11/2011 | Hales et al. |
| 8,069,789 | B2 | 12/2011 | Hummel et al. |
| 8,074,713 | B2 | 12/2011 | Ramos et al. |
| 8,074,737 | B2 | 12/2011 | Hill et al. |
| 8,079,296 | B2 | 12/2011 | Barton et al. |
| 8,091,477 | B2 | 1/2012 | Brooks et al. |
| 8,127,846 | B2 | 3/2012 | Hill et al. |
| 8,136,439 | B2 | 3/2012 | Bell |
| 8,141,434 | B2 | 3/2012 | Kippersund et al. |
| 8,151,882 | B2 | 4/2012 | Grigar et al. |
| 8,157,022 | B2 | 4/2012 | Bertoja et al. |
| 8,181,718 | B2 | 5/2012 | Burleson et al. |
| 8,182,212 | B2 | 5/2012 | Parcell |
| 8,186,259 | B2 | 5/2012 | Burleson et al. |
| 8,230,788 | B2 | 7/2012 | Brooks et al. |
| 8,256,337 | B2 | 9/2012 | Hill |
| 8,336,437 | B2 | 12/2012 | Barlow et al. |
| 8,387,533 | B2 | 3/2013 | Runkel |
| 8,388,374 | B2 | 3/2013 | Grek et al. |
| 8,395,878 | B2 | 3/2013 | Stewart et al. |
| 8,413,727 | B2 | 4/2013 | Holmes |
| 8,439,114 | B2 | 5/2013 | Parrott et al. |
| 8,451,137 | B2 | 5/2013 | Bonavides et al. |
| 8,468,944 | B2 | 6/2013 | Givens et al. |
| 8,596,378 | B2 | 12/2013 | Mason et al. |
| 8,661,978 | B2 | 3/2014 | Backhus et al. |
| 8,678,666 | B2 | 3/2014 | Scadden et al. |
| 8,695,506 | B2 | 4/2014 | Lanclos |
| 8,807,003 | B2 | 8/2014 | Le et al. |
| 8,833,441 | B2 | 9/2014 | Fielder et al. |
| 8,863,665 | B2 | 10/2014 | DeVries et al. |
| 8,869,887 | B2 | 10/2014 | Deere et al. |
| 8,875,787 | B2 | 11/2014 | Tassaroli |
| 8,875,796 | B2 | 11/2014 | Hales et al. |
| 8,881,816 | B2 | 11/2014 | Glenn et al. |
| 8,884,778 | B2 | 11/2014 | Lerche et al. |
| 8,943,943 | B2 | 2/2015 | Tassaroli |
| 8,960,093 | B2 | 2/2015 | Preiss et al. |
| 8,960,288 | B2 | 2/2015 | Sampson |
| 9,065,201 | B2 | 6/2015 | Borgfeld et al. |
| 9,080,433 | B2 | 7/2015 | Lanclos et al. |
| 9,145,763 | B1 | 9/2015 | Sites, Jr. |
| 9,145,764 | B2 | 9/2015 | Burton et al. |
| 9,181,790 | B2 | 11/2015 | Mace et al. |
| 9,194,219 | B1 | 11/2015 | Hardesty et al. |
| 9,206,675 | B2 | 12/2015 | Hales et al. |
| 9,284,819 | B2 | 3/2016 | Tolman et al. |
| 9,284,824 | B2 | 3/2016 | Fadul et al. |
| 9,297,242 | B2 | 3/2016 | Zhang et al. |
| 9,317,038 | B2 | 4/2016 | Ozick et al. |
| 9,359,863 | B2 | 6/2016 | Streich et al. |
| 9,383,237 | B2 | 7/2016 | Wiklund et al. |
| 9,441,438 | B2 | 9/2016 | Allison et al. |
| 9,466,916 | B2 | 10/2016 | Li et al. |
| 9,476,289 | B2 | 10/2016 | Wells |
| 9,484,646 | B2 | 11/2016 | Thomas |
| 9,494,021 | B2 | 11/2016 | Parks et al. |
| 9,523,265 | B2 | 12/2016 | Upchurch et al. |
| 9,523,271 | B2 | 12/2016 | Bonavides et al. |
| 9,581,422 | B2 | 2/2017 | Preiss et al. |
| 9,593,548 | B2 | 3/2017 | Hill et al. |
| 9,598,942 | B2 | 3/2017 | Wells et al. |
| 9,605,937 | B2 | 3/2017 | Eitschberger et al. |
| 9,617,814 | B2 | 4/2017 | Seals et al. |
| 9,634,427 | B2 | 4/2017 | Lerner et al. |
| 9,650,848 | B2 | 5/2017 | Taylor et al. |
| 9,677,363 | B2 | 6/2017 | Schacherer et al. |
| 9,689,223 | B2 | 6/2017 | Schacherer et al. |
| 9,695,645 | B2 | 7/2017 | Tilley et al. |
| 9,702,211 | B2 | 7/2017 | Tinnen |
| 9,702,680 | B2 | 7/2017 | Parks et al. |
| 9,709,373 | B2 | 7/2017 | Hikone et al. |
| 9,784,549 | B2 | 10/2017 | Eitschberger |
| 9,903,192 | B2 | 2/2018 | Entchev et al. |
| 10,066,921 | B2 | 9/2018 | Eitschberger |
| 10,077,641 | B2 | 9/2018 | Man et al. |
| 10,138,713 | B2 | 11/2018 | Tolman et al. |
| 10,151,180 | B2 | 12/2018 | Robey et al. |
| 10,188,990 | B2 | 1/2019 | Burmeister et al. |
| 10,190,398 | B2 | 1/2019 | Goodman et al. |
| 10,352,144 | B2 | 7/2019 | Entchev et al. |
| 10,400,558 | B1 | 9/2019 | Shahinpour et al. |
| 10,458,213 | B1 | 10/2019 | Eitschberger et al. |
| 10,502,036 | B2 | 12/2019 | Spring |
| 10,731,444 | B2 | 8/2020 | Wells et al. |
| 10,746,014 | B2 | 8/2020 | Ito et al. |
| 10,900,333 | B2 | 1/2021 | Langford et al. |
| 10,900,335 | B2 | 1/2021 | Knight et al. |
| 11,078,762 | B2 | 8/2021 | Mauldin et al. |
| 11,091,987 | B1 | 8/2021 | Benker et al. |
| 11,118,436 | B2 | 9/2021 | Langford et al. |
| 11,215,041 | B2 | 1/2022 | Knight et al. |
| 11,299,967 | B2 | 4/2022 | Bradley et al. |
| 11,359,468 | B2 | 6/2022 | Roberts et al. |
| 2002/0020320 | A1 | 2/2002 | Lebaudy et al. |
| 2002/0062991 | A1 | 5/2002 | Farrant et al. |
| 2003/0000411 | A1 | 1/2003 | Cernocky et al. |
| 2003/0001753 | A1 | 1/2003 | Cernocky et al. |
| 2004/0141279 | A1 | 7/2004 | Amano et al. |

(56) References Cited

U.S. PATENT DOCUMENTS

| | | | |
|---|---|---|---|
| 2004/0211862 | A1 | 10/2004 | Elam |
| 2005/0178282 | A1 | 8/2005 | Brooks et al. |
| 2005/0183610 | A1 | 8/2005 | Barton et al. |
| 2005/0186823 | A1 | 8/2005 | Ring et al. |
| 2005/0194146 | A1 | 9/2005 | Barker et al. |
| 2005/0218260 | A1 | 10/2005 | Corder et al. |
| 2005/0229805 | A1 | 10/2005 | Myers, Jr. et al. |
| 2005/0257710 | A1 | 11/2005 | Monetti et al. |
| 2007/0084336 | A1 | 4/2007 | Neves |
| 2007/0125540 | A1 | 6/2007 | Gerez et al. |
| 2007/0158071 | A1 | 7/2007 | Mooney, Jr. et al. |
| 2008/0029302 | A1 | 2/2008 | Scott |
| 2008/0047456 | A1 | 2/2008 | Li et al. |
| 2008/0047716 | A1 | 2/2008 | McKee et al. |
| 2008/0073081 | A1 | 3/2008 | Frazier et al. |
| 2008/0110612 | A1 | 5/2008 | Prinz et al. |
| 2008/0134922 | A1 | 6/2008 | Grattan et al. |
| 2008/0149338 | A1 | 6/2008 | Goodman et al. |
| 2008/0173204 | A1 | 7/2008 | Anderson et al. |
| 2008/0173240 | A1 | 7/2008 | Furukawahara et al. |
| 2008/0264639 | A1 | 10/2008 | Parrott et al. |
| 2009/0050322 | A1 | 2/2009 | Hill et al. |
| 2009/0159285 | A1 | 6/2009 | Goodman |
| 2009/0272519 | A1 | 11/2009 | Green et al. |
| 2009/0272529 | A1 | 11/2009 | Crawford |
| 2009/0301723 | A1 | 12/2009 | Gray |
| 2010/0000789 | A1 | 1/2010 | Barton et al. |
| 2010/0012774 | A1 | 1/2010 | Fanucci et al. |
| 2010/0022125 | A1 | 1/2010 | Burris et al. |
| 2010/0024674 | A1 | 2/2010 | Peeters et al. |
| 2010/0089643 | A1 | 4/2010 | Vidal |
| 2010/0096131 | A1 | 4/2010 | Hill et al. |
| 2010/0107917 | A1 | 5/2010 | Moser |
| 2010/0163224 | A1 | 7/2010 | Strickland |
| 2010/0230104 | A1 | 9/2010 | Nölke et al. |
| 2010/0252323 | A1 | 10/2010 | Goodman et al. |
| 2011/0024116 | A1 | 2/2011 | McCann et al. |
| 2011/0042069 | A1 | 2/2011 | Bailey et al. |
| 2011/0100627 | A1 | 5/2011 | Hales et al. |
| 2011/0301784 | A1 | 12/2011 | Oakley et al. |
| 2012/0006217 | A1 | 1/2012 | Anderson |
| 2012/0085538 | A1 | 4/2012 | Guerrero et al. |
| 2012/0094553 | A1 | 4/2012 | Fujiwara et al. |
| 2012/0160483 | A1 | 6/2012 | Carisella |
| 2012/0199031 | A1 | 8/2012 | Lanclos |
| 2012/0199352 | A1 | 8/2012 | Lanclos et al. |
| 2012/0241169 | A1 | 9/2012 | Hales et al. |
| 2012/0242135 | A1 | 9/2012 | Thomson et al. |
| 2012/0247769 | A1 | 10/2012 | Schacherer et al. |
| 2012/0247771 | A1 | 10/2012 | Black et al. |
| 2012/0298361 | A1 | 11/2012 | Sampson |
| 2013/0008639 | A1 | 1/2013 | Tassaroli et al. |
| 2013/0008669 | A1 | 1/2013 | Deere et al. |
| 2013/0037255 | A1 | 2/2013 | Kash et al. |
| 2013/0043074 | A1 | 2/2013 | Tassaroli |
| 2013/0062055 | A1 | 3/2013 | Tolman et al. |
| 2013/0112396 | A1 | 5/2013 | Splittstoeßer |
| 2013/0118342 | A1 | 5/2013 | Tassaroli |
| 2013/0199843 | A1 | 8/2013 | Ross |
| 2013/0220614 | A1 | 8/2013 | Torres et al. |
| 2013/0248174 | A1 | 9/2013 | Dale et al. |
| 2013/0256464 | A1 | 10/2013 | Belik et al. |
| 2014/0000877 | A1 | 1/2014 | Robertson et al. |
| 2014/0033939 | A1 | 2/2014 | Priess et al. |
| 2014/0053750 | A1 | 2/2014 | Lownds et al. |
| 2014/0127941 | A1 | 5/2014 | Lu |
| 2014/0131035 | A1 | 5/2014 | Entchev et al. |
| 2014/0148044 | A1 | 5/2014 | Balcer et al. |
| 2014/0251612 | A1 | 9/2014 | Powers |
| 2015/0075783 | A1 | 3/2015 | Angman et al. |
| 2015/0176386 | A1 | 6/2015 | Castillo et al. |
| 2015/0226044 | A1 | 8/2015 | Ursi et al. |
| 2015/0308208 | A1 | 10/2015 | Capps et al. |
| 2015/0330192 | A1 | 11/2015 | Rogman et al. |
| 2015/0345922 | A1 | 12/2015 | Lanclos et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0178333 | A1 | 6/2016 | Biggs et al. |
| 2016/0273902 | A1 | 9/2016 | Eitschberger |
| 2016/0333675 | A1 | 11/2016 | Wells et al. |
| 2016/0365667 | A1 | 12/2016 | Mueller et al. |
| 2017/0030693 | A1 | 2/2017 | Preiss et al. |
| 2017/0052011 | A1 | 2/2017 | Parks et al. |
| 2017/0145798 | A1 | 5/2017 | Robey et al. |
| 2017/0211363 | A1 | 7/2017 | Bradley et al. |
| 2017/0241244 | A1 | 8/2017 | Barker et al. |
| 2017/0268860 | A1 | 9/2017 | Eitschberger |
| 2017/0314372 | A1 | 11/2017 | Tolman et al. |
| 2018/0030334 | A1 | 2/2018 | Collier et al. |
| 2018/0135398 | A1 | 5/2018 | Entchev et al. |
| 2018/0202789 | A1 | 7/2018 | Parks et al. |
| 2018/0209251 | A1 | 7/2018 | Robey et al. |
| 2018/0274342 | A1 | 9/2018 | Sites |
| 2018/0299239 | A1 | 10/2018 | Eitschberger et al. |
| 2018/0318770 | A1 | 11/2018 | Eitschberger et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0195054 | A1 | 6/2019 | Bradley et al. |
| 2019/0211655 | A1 | 7/2019 | Bradley et al. |
| 2019/0284889 | A1 | 9/2019 | LaGrange et al. |
| 2019/0292887 | A1 | 9/2019 | Austin, II et al. |
| 2019/0316449 | A1 | 10/2019 | Schultz et al. |
| 2020/0063553 | A1 | 2/2020 | Zemla et al. |
| 2020/0088011 | A1 | 3/2020 | Eitschberger et al. |
| 2020/0182025 | A1 | 6/2020 | Brady |
| 2020/0284126 | A1 | 9/2020 | Mauldin et al. |
| 2020/0362652 | A1 | 11/2020 | Eitschberger et al. |
| 2020/0362654 | A1 | 11/2020 | Eitschberger et al. |
| 2020/0378731 | A1 | 12/2020 | Mcnelis |
| 2020/0399995 | A1 | 12/2020 | Preiss et al. |
| 2021/0348485 | A1 | 11/2021 | Mauldin et al. |
| 2022/0098947 | A1 | 3/2022 | Eitschberger |
| 2022/0170727 | A1 | 6/2022 | Eitschberger |

FOREIGN PATENT DOCUMENTS

| | | | |
|---|---|---|---|
| CA | 2821506 | A1 | 1/2015 |
| CA | 2824838 | A1 | 2/2015 |
| CA | 2888787 | A1 | 10/2015 |
| CA | 2980935 | A1 | 10/2016 |
| CA | 3090586 | A1 | 2/2021 |
| CN | 85107897 | A | 9/1986 |
| CN | 2648065 | | 10/2004 |
| CN | 2661919 | | 12/2004 |
| CN | 2821154 | | 9/2006 |
| CN | 101397890 | A | 4/2009 |
| CN | 101691837 | B | 4/2010 |
| CN | 101178005 | B | 10/2010 |
| CN | 201620848 | U | 11/2010 |
| CN | 201764910 | U | 3/2011 |
| CN | 102878877 | A | 1/2013 |
| CN | 103993861 | A | 8/2014 |
| CN | 104989335 | A | 10/2015 |
| DE | 102007007498 | | 10/2015 |
| EP | 0088516 | A1 | 9/1983 |
| EP | 0160449 | A1 | 11/1985 |
| EP | 132330 | B1 | 9/1988 |
| EP | 0216527 | B1 | 11/1990 |
| EP | 0416915 | A2 | 3/1991 |
| EP | 0180520 | B1 | 5/1991 |
| EP | 679859 | A2 | 11/1995 |
| EP | 0482969 | B1 | 8/1996 |
| EP | 694157 | B1 | 8/2001 |
| EP | 2702349 | B1 | 11/2015 |
| EP | 2310616 | B1 | 10/2017 |
| EP | 3277913 | A1 | 2/2018 |
| GB | 2383236 | B | 1/2004 |
| JP | 2003329399 | A | 11/2003 |
| RU | 2295694 | C2 | 3/2007 |
| RU | 78521 | U1 | 11/2008 |

(56) References Cited

FOREIGN PATENT DOCUMENTS

| | | | |
|---|---|---|---|
| RU | 93521 | U1 | 4/2010 |
| RU | 100552 | U1 | 12/2010 |
| RU | 2434122 | C2 | 11/2011 |
| RU | 2561828 | C2 | 9/2015 |
| RU | 2579307 | C1 | 4/2016 |
| RU | 2633904 | C1 | 10/2017 |
| WO | 8802056 | A1 | 3/1988 |
| WO | 1994009246 | A1 | 4/1994 |
| WO | 9905390 | A1 | 2/1999 |
| WO | 1999005390 | A1 | 2/1999 |
| WO | 0133029 | A3 | 5/2001 |
| WO | 0159401 | A1 | 8/2001 |
| WO | 2001059401 | A1 | 8/2001 |
| WO | 2008098052 | A3 | 10/2008 |
| WO | 2009091422 | A2 | 7/2009 |
| WO | 2009091422 | A3 | 3/2010 |
| WO | 2012006357 | A2 | 1/2012 |
| WO | 2012135101 | A2 | 10/2012 |
| WO | 2012106640 | A3 | 11/2012 |
| WO | 2012149584 | A1 | 11/2012 |
| WO | 2014046670 | A1 | 3/2014 |
| WO | 2014089194 | A1 | 6/2014 |
| WO | 2015006869 | A1 | 1/2015 |
| WO | 2015028204 | A2 | 3/2015 |
| WO | 2015134719 | A1 | 9/2015 |
| WO | 2016100269 | A1 | 6/2016 |
| WO | 2018009223 | A1 | 1/2018 |
| WO | 2018026952 | A1 | 2/2018 |
| WO | 2019148009 | A2 | 8/2019 |
| WO | 2021198193 | A1 | 10/2021 |

OTHER PUBLICATIONS

G&H Diversified Manufacturing, LP; Plaintiff and Counterclaim Defendant G&H Diversified Manufacturing, LP and Counterclaim Defendant Yellow Jacket Oil Tools, LLC's Proposed Constructions; dated Jun. 10, 2021; 7 pages.
G&H Diversified Manufacturing, LP; Redated Petition for Post Grant Review for PGR2021-00078; dated May 10, 2021; 20 pages.
G&H Diversified Manufacturing, LP; Reply to Preliminary Response for PGR No. PGR2021-00078; dated Sep. 14, 2021; 18 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Notification of Grant for GB Appl. No. 1717516.7; dated Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
German Patent Office, Office Action for German Patent Application No. 10 2013 109 227.6, which is in the same family as PCT Application No. PCT/EP2014/065752, see p. 5 for references cited, May 22, 2014, 8 pgs.
Gilliat et al.; New Select-Fire System: Improved Reliability and Safety in Select Fire Operations; 2012; 16 pgs.
Global Wireline Market; Exhibit 2010 of PGR 2020-00072; dated Oct. 15, 2019; 143 pages.
GR Energy Operating GP LLC, GR Energy Services Management, LP and GR Energy Services, LLC; Exhibit A U.S. Pat. No. 10,844,697 vs Castel; dated Aug. 30, 2021; 88 pages.
GR Energy Operating GP LLC, GR Energy Services Management, LP and GR Energy Services, LLC; Exhibit B U.S. Pat. No. 10,844,697 vs Goodman; dated Aug. 30, 2021; 36 pages.
GR Energy Operating GP LLC, GR Energy Services Management, LP and GR Energy Services, LLC; Exhibit C U.S. Pat. No. 10,844,697 vs Hromas; dated Aug. 30, 2021; 27 pages.
GR Energy Operating GP LLC, GR Energy Services Management, LP and GR Energy Services, LLC; Exhibit D U.S. Pat. No. 10,844,697 vs Boop 768; dated Aug. 30, 2021; 35 pages.
GR Energy Operating GP LLC, GR Energy Services Management, LP and GR Energy Services, LLC; Exhibit E U.S. Pat. No. 10,844,697 vs Boop 792; dated Aug. 30, 2021; 52 pages.
GR Energy Operating GP LLC, GR Energy Services Management, LP and GR Energy Services, LLC; Exhibit F U.S. Pat. No. 10,844,697 vs Boop 378; dated Aug. 30, 2021; 34 pages.
GR Energy Operating GP LLC, GR Energy Services Management, LP and GR Energy Services, LLC; Exhibit G U.S. Pat. No. 10,844,697 vs Bickford; dated Aug. 30, 2021; 7 pages.
GR Energy Operating GP LLC, GR Energy Services Management, LP and GR Energy Services, LLC; Exhibit H U.S. Pat. No. 10,844,697 vs Black; dated Aug. 30, 2021; 33 pages.
GR Energy Operating GP LLC, GR Energy Services Management, LP and GR Energy Services, LLC; Exhibit I U.S. Pat. No. 10,844,697 vs Rogman; dated Aug. 30, 2021; 59 pages.
GR Energy Operating GP LLC, GR Energy Services Management, LP and GR Energy Services, LLC; Exhibit J U.S. Pat. No. 10,844,697 vs Burton; dated Aug. 30, 2021; 57 pages.
GR Energy Operating GP LLC, GR Energy Services Management, LP and GR Energy Services, LLC; Exhibit K U.S. Pat. No. 10,844,697 vs Borgfeld; dated Aug. 30, 2021; 36 pages.
GR Energy Operating GP LLC, GR Energy Services Management, LP and GR Energy Services, LLC; Exhibit L U.S. Pat. No. 10,844,697 vs Boop '383; dated Aug. 30, 2021; 24 pages.
GR Energy Operating GP LLC, GR Energy Services Management, LP and GR Energy Services, LLC; Exhibit M U.S. Pat. No. 10,844,697 vs Boop '992; dated Aug. 30, 2021; 14 pages.
GR Energy Operating GP LLC, GR Energy Services Management, LP and GR Energy Services, LLC; Exhibit N U.S. Pat. No. 10,844,697 vs Deere; dated Aug. 30, 2021; 14 pages.
GR Energy Operating GP LLC, GR Energy Services Management, LP and GR Energy Services, LLC; Exhibit O U.S. Pat. No. 10,844,697 vs Harrigan Provisional; dated Aug. 30, 2021; 26 pages.
GR Energy Operating GP LLC, GR Energy Services Management, LP and GR Energy Services, LLC; Exhibit P U.S. Pat. No. 10,844,697 vs Burke '251; dated Aug. 30, 2021; 7 pages.
GR Energy Operating GP LLC, GR Energy Services Management, LP and GR Energy Services, LLC; Exhibit Q U.S. Pat. No. 10,844,697 vs Runkel; dated Aug. 30, 2021; 7 pages.
GR Energy Operating GP LLC, GR Energy Services Management, LP and GR Energy Services, LLC; Exhibit R U.S. Pat. No. 10,844,697 vs Tassaroli; dated Aug. 30, 2021; 10 pages.
GR Energy Operating GP LLC, GR Energy Services Management, LP and GR Energy Services, LLC; Exhibit S U.S. Pat. No. 10,844,697 vs Harrigan '048; dated Aug. 30, 2021; 7 pages.
GR Energy Operating GP LLC, GR Energy Services Management, LP and GR Energy Services, LLC; Exhibit T U.S. Pat. No. 10,844,697 vs Select-Fire System; dated Aug. 30, 2021; 36 pages.
GR Energy Operating GP LLC, GR Energy Services Management, LP and GR Energy Services, LLC; Exhibit U U.S. Pat. No. 10,844,697 vs New Select-Fire System; dated Aug. 30, 2021; 37 pages.
GR Energy Operating GP LLC, GR Energy Services Management, LP and GR Energy Services, LLC; Exhibit V U.S. Pat. No. 10,844,697 vs EWAPS; dated Aug. 30, 2021; 17 pages.
GR Energy Operating GP LLC, GR Energy Services Management, LP and GR Energy Services, LLC; Exhibit W U.S. Pat. No. 10,844,697 vs SafeJet System; dated Aug. 30, 2021; 17 pages.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
GR Energy Services Operating GP LLC, GR Energy Services Management, LP and GR Energy Services, LLC; GR Energy's Opening Claim Construction Brief; dated Oct. 18, 2021; 23 pages.
Heard, Preston; Declaration for PGR2021-00078; dated Aug. 19, 2021; 5 pages.

(56) References Cited

OTHER PUBLICATIONS

Horizontal Wireline Services, LLC and Allied Wireline Services, LLC; Defendants' Opening Claim Construction Brief; dated Oct. 18, 2021; 27 pages.
Horizontal Wireline Services, LLC and Allied Wireline Services, LLC; Defendants' Preliminary Invalidity Contentions for Civil Action No. 6:21-cv-00349-ADA; dated Aug. 30, 2021; 22 pages.
Horizontal Wireline Services, LLC and Allied Wireline Services, LLC; Exhibit A1 U.S. Pat. No. 5,155,293 to Barton vs. Asserted Claims of U.S. Pat. No. 10,844,697; dated Aug. 30, 2021; 21 pages.
Horizontal Wireline Services, LLC and Allied Wireline Services, LLC; Exhibit A23 Amit Govil, "Selective Perforation: A Game Changer in Perforating Technology—Case Study," 2012 European and West African Perforating Symposium vs. Asserted Claims of U.S. Pat. No. 10,844,697; dated Aug. 30, 2021; 17 pages.
Horizontal Wireline Services, LLC and Allied Wireline Services, LLC; Exhibit A5 U.S. Pat. No. 9,175,553 to Mcann, et al. vs. Asserted Claims of U.S. Pat. No. 10,844,697; dated Aug. 30, 2021; 26 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-CV-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, Electrical Cable Heads, May 8, 2016, 4 pgs., http://www.hunting-intl.com/media/1967991/ElectricalCableHeads.pdf.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, Inc.; Defendant's Answer, Affirmative Defenses, and Counterclaims to Plaintiffs' Second Amended Complaint for Civil Action No. 4:20-cv-02123; dated Sep. 10, 2021; 77 pages.
Hunting Titan, Inc.; Defendant's Responsive Claim Construction Brief for Civil Action No. 4:20-cv-02123; dated Oct. 1, 2021; 31 pages.
Hunting Titan, Inc.; Defendant's Supplemental Brief on Claim Construction; dated Nov. 5, 2021; 9 pages.
Hunting Titan, Inc; Petitioner's Sur-Reply on Patent Owner's Motion to Amend for IPR No. 2018-00600; dated Apr. 11, 2019; 17 pages.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; Response to Canadian Office Action for CA App. No. 2,933,756; dated Nov. 23, 2017; 18 pages.
Industrial Property Office, Czech Republic; Office Action for CZ App. No. PV 2017-675; dated Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
Intellectual Property India, Office Action of IN Application No. 201647004496, dated Jun. 7, 2019, 6 pgs.
International Bureau; International Preliminary Report on Patentability for PCT Application #PCT/EP2019/063214; dated Dec. 24, 2020; 9 pages.
International Searching Authority, International Preliminary Report on Patentability for PCT App. No. PCT/EP2014/065752; dated Mar. 1, 2016, 10 pgs.
International Searching Authority, International Search and Written Opinion of International App. No. PCT/EP2020/058241, dated Aug. 10, 2020, 18 pgs.
International Searching Authority; Communication Relating to the Results of the Partial International Search for PCT/EP2020/070291; dated Oct. 20, 2020; 8 pages.
International Searching Authority; International Preliminary Report on Patentability for PCT Appl. No. PCT/CA2014/050673; dated Jan. 19, 2016; 5 pages.
International Searching Authority; International Preliminary Report on Patentability for PCT Application No. PCT/EP2019/069165; dated Jan. 28, 2021; 9 pages.
International Searching Authority; International Preliminary Report on Patentability for PCT Application No. PCT/IB2019/000569; dated Jan. 28, 2021; 8 pages.
International Searching Authority; International Search Report and Written Opinion for International Application No. PCT/US19/15255; dated Apr. 23, 2019; 12 pages.
International Searching Authority; International Search Report and Written Opinion for International Application No. PCT/US2020/032879; dated Aug. 20, 2020; 9 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/EP2019/072064; dated Nov. 20, 2019; 15 pages.
International Searching Authority; International Search Report and Written Opinion for PCT App. No. PCT/US2015/018906; dated Jul. 10, 2015; 12 pages.
International Searching Authority; International Search Report and Written Opinion for PCT Application No. EP2020066327; dated Jan. 11, 2021; 17 pages.
International Searching Authority; International Search Report and Written Opinion of the International Searching Authority for PCT/EP2020/085622; dated Apr. 1, 2021; 10 pages.
International Searching Authority; International Search Report and Written Opinion of the International Searching Authority for PCT/EP2020/085624; dated Apr. 12, 2021; 11 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.

(56) References Cited

OTHER PUBLICATIONS

Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Lehr, Doug; Declaration of Doug Lehr in Supprt of Repeat Precision's Response Claim Construction Brief; dated Oct. 27, 2021; 35 pages.
Logan, et al.; International Patent Application No. PCT/CA2013/050986; dated Dec. 18, 2013; 54 pages.
Markel, Dan; Declaration regarding the SafeJet System for PGR2021-00097; dated Jul. 15, 2021; 21 pages.
McNelis et al.; High-Performance Plug-and-Perf Completions in Unconventional Wells; Society of Petroleum Engineers Annual Technical Conference and Exhibition; Sep. 28, 2015.
Meehan, Nathan; Declaration of D. Nathan Meehan, Ph.D, P.E; dated Oct. 18, 2021; 86 pages.
merriam-webster.com, Insulator Definition, https://www.merriam-webster.com/dictionary/insulator, Jan. 31, 2018, 4 pages.
Nextier Completion Solutions Inc.; Defendant NexTier Completion Solution Inc.'s Opening Claim Construction Brief; dated Oct. 18, 2021; 26 pages.
Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.
Nextier Completion Solutions Inc.; Defendant's Preliminary Invalidity Contentions for Civil Action No. 6:20-cv-01201-ADA; dated Aug. 30, 2021; 21 pages.
United States Patent and Trial Appeal Board; Final Written Decision on IPR2018-00600; dated Aug. 20, 2019; 31 pages.
United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.
United States Patent Trial and Appeal Board; Record of Oral Hearing held Feb. 18, 2020 for IPR dated 2018-00600; dated Feb. 18, 2020; 27 pages.
Vigor Petroleum; Perforating Gun Accessories Product Description; https://www.vigordrilling.com/completion-tools/perforating-gun-accessories.html; 2021; 1 page.
Wetechnologies; Downhole Connectors, High Pressure HP / HT & Medium Pressure MP /MT; dated Apr. 3, 2016; http://wetechnologies.com/products/hp-ht-downhole/; 3 pages.
Williams, John; Declaration of Dr. John Williams; dated Oct. 18, 2021; 9 pages.
WIPO, International Search Report for International Application No. PCT/CA2014/050673, dated Oct. 9, 2014, 3 pgs.
WIPO, Written Opinion of International Searching Authority for PCT Application No. PCT/CA2014/050673, dated Oct. 9, 2014, 4 pgs.
Wooley, Gary R.; Declaration in Support of Petition for Post Grant Review of U.S. Pat. No. 10,844,697 for PGR2021-00097; dated Jul. 17, 2021; 90 pages.
Wooley, Gary; Declaration of Gary E. Wooley for Civil Action Nos. 6:20-cv-01110-ADA and 6:20-CV-01201-ADA; dated Oct. 18, 2021; 12 pages.
Wooley, Gary; Declaration of Gary R. Wooley for Civil Action No. 3:20-cv-00376; dated Jul. 8, 2021; 11 pages.
Wooley, Gary; Declaration of Gary R. Wooley for Civil Action No. 3:21-cv-00192-M; dated Aug. 17, 2021; 18 pages.
Wooley, Gary; Transcript of Gary Wooley for Civil Action No. 3:21-cv-00192-M; dated Sep. 2, 2021; 26 pages.
Yellow Jacket Oil Tools, LLC; Defendant Yellow Jacket Oil Tools, LLC's Answer to Plaintiffs' First Amended Complaint for Civil Action No. 6:20-cv-01110; dated Aug. 10, 2021; 13 pages.
Yellowjacket Oil Tools, LLC and G&H Diversified Manufacturing, LP; Defendants' Preliminaray Invalidity Contentions for Civil Action No. 6:20-cv-01110-ADA; dated May 6, 2021; 20 pages.
Yellowjacket Oil Tools, LLC and G&H Diversified Manufacturing, Lp; Defendants' Preliminary Invalidity Contentions for Civil Action No. 6:20-cv-01110-ADA; dated Aug. 30, 2021; 21 pages.
Yellowjacket Oil Tools, LLC and G&H Diversified Manufacturing, LP; Exhibit A-9 Selective perforation: A Game Changer in Peforating Technology—Case Study; dated Aug. 30, 2021; 13 pages.
Yellowjacket, G&H and Nextier, Invalidity Chart in Litigation re Schlumberger SafeJet, dated as early as Aug. 30, 2021, 13 pgs.
Yellowjacket, G&H and Nextier, Invalidity Chart in Litigation re U.S. Pat. No. 10,844,697, "New Select-Fire System" Publication and Select-Fire System by BakerHughes vs. Asserted Claims, dated as early as Aug. 30, 2021, 33 pgs.
Yellowjacket, G&H and Nextier, Invalidity Chart in Litigation re U.S. Pat. No. 10,844,697, New Select-Fire System vs. Asserted Claims, dated as early as Aug. 30, 2021, 33 pgs.
Yellowjacket, G&H and Nextier, Invalidity Chart in Litigation re U.S. Pat. No. 10,844,697, U.S. Patent Publication No. 2013/0126237 A1 to Burton vs Asserted Claims, dated as early as Aug. 30, 2021, 3 pgs.
Yellowjacket, G&H and Nextier, Invalidity Chart in Litigation re U.S. Pat. No. 10,844,697, U.S. Patent Publication No. 2016 0084048 A1 to Harrigan et al. vs. Asserted Claims, dated as early as Aug. 30, 2021, 4 pgs.
Yellowjacket, G&H and Nextier, Invalidity Chart in Litigation re U.S. Pat. No. 10,844,697, U.S. Appl. No. 61/733,129 vs. Asserted Claims, dated as early as Aug. 30, 2021, 55 pgs.
Yellowjacket, G&H and Nextier, Invalidity Chart in Litigation re U.S. Pat. No. 10,844,697, U.S. Appl. No. 61/819,196 to Harrigan et al. vs Asserted Claims, dated as early as Aug. 30, 2021, 26 pgs.
Yellowjacket, G&H and Nextier, Invalidity Chart in Litigation re U.S. Pat. No. 10,844,697, US Pub. No. 2012/0247771 vs. Asserted Claims, dated as early as Aug. 30, 2021, 30 pgs.
Yellowjacket, G&H and Nextier, Invalidity Chart in Litigation re U.S. Pat. No. 10,844,697, U.S. Pat. No. 10,077,641 to Rogman vs. Asserted Claims, dated as early as Aug. 30, 2021, 36 pgs.
Yellowjacket, G&H and Nextier, Invalidity Chart in Litigation re U.S. Pat. No. 10,844,697, U.S. Pat. No. 3,173,229 to Gene T. Boop vs. Asserted Claims, dated as early as Aug. 30, 2021, 12 pgs.
Yellowjacket, G&H and Nextier, Invalidity Chart in Litigation re U.S. Pat. No. 10,844,697, U.S. Pat. No. 4,457,383 to Gene T. Boop vs. Asserted Claims, dated as early as Aug. 30, 2021, 22 pgs.
Yellowjacket, G&H and Nextier, Invalidity Chart in Litigation re U.S. Pat. No. 10,844,697, U.S. Pat. No. 6,506,083 vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 6,582,251 to Burke el al. vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 7,226,303 to Shaikh vs. Asserted Claims, dated as early as Aug. 30, 2021, 4 pgs.
Yellowjacket, G&H and Nextier, Invalidity Chart in Litigation re U.S. Pat. No. 10,844,697, U.S. Pat. No. 7,762,331 to Goodman vs. Asserted Claims, dated as early as Aug. 30, 2021, 4 pgs.
Yellowjacket, G&H and Nextier, Invalidity Chart in Litigation re U.S. Pat. No. 10,844,697, U.S. Pat. No. 8,387,533 to Runkel vs. Asserted Claims, dated as early as Aug. 30, 2021, 5 pgs.
Yellowjacket, G&H and Nextier, Invalidity Chart in Litigation re U.S. Pat. No. 10,844,697, U.S. Pat. No. 8,943,943 to Carlos Jose Tassaroli vs. Asserted Patents, dated as early as Aug. 30, 2021, 7 pgs.
Yellowjacket, G&H and Nextier, Invalidity Chart in Litigation re U.S. Pat. No. 10,844,697, U.S. Pat. No. 9,065,201 to Borgfeld et al vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 9,874,083 to Logan vs. Asserted Claims, dated as early as Aug. 30, 2021, 18 pgs.
Amit Govil, Selective Perforation: A Game Changer in Perforating Technology—Case Study, presented at the 2012 European and West African Perforating Symposium, Schlumberger, Nov. 7-9. 2012, 14 pgs.

(56) References Cited

OTHER PUBLICATIONS

Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Bear Manufacturing, LLC; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Bear Manufacturing, LLC; Defendant's Preliminary Invalidity Contentions; dated Aug. 4, 2021; 23 pages.
Bear Manufacturing, LLC; Exhibit A1 U.S. Pat. No. 5,155,293 to Barton vs. Asserted Claims of U.S. Pat. No. 10,844,697; dated Aug. 4, 2021; 21 pages.
Bear MFG and Oso Perf, Invalidity Contentions in Litigation re Amit Govil, "Selective Perforation: A Game Changer in Perforating Technology—Case Study," 2012 European and West African Perforating Symposium ("EWAPS") vs. Asserted Claims of U.S. Pat. No. 10,844,697, dated as early as Aug. 4, 2021, 17 pgs.
Bear MFG and Oso Perf, Invalidity Contentions in Litigation re U.S. Pat. No. 9,175,553 to McCann, et al. vs. Asserted Claims of U.S. Pat. No. 10,844,697, dated as early as Aug. 4, 2021, 26 pgs.
Bear MFG, Oso Perf, Horizontal Wireline and Allied Horizontal, Invalidity Chart in Litigation re U.S. Pat. No. 10,844,697, U.S. Pat. No. 6,506,083 vs. Asserted Claims, dated as early as Aug. 4, 2021, 17 pgs.
Bear MFG, Oso Perf, Horizontal Wireline and Allied Horizontal, Invalidity Contentions in Litigation re U.S. Pat. No. 10,844,697, "New Select-Fire System" Publication and Select-Fire System by BakerHughes vs. Asserted Claims, dated as early as Aug. 4, 2021, 14 pgs.
Bear MFG, Oso Perf, Horizontal Wireline and Allied Wireline, Invalidity Chart in Litigation re U.S. Pat. No. 10,844,697, US Pub No. 2012/0247771 vs. Asserted Claims, dated as early as Aug. 4, 2021, 26 pgs.
Bear MFG, Oso Perf, Horizontal Wireline and Allied Wireline, Invalidity Contentions in Litigation re "3.12-in Frac Gun" Publication and 3.12-in Frac Gun System by Sclumberger vs. Asserted Claims of U.S. Pat. No. 10,844,697, dated as early as Aug. 4, 2021, 26 pgs.
Bear MFG, Oso Perf, Horizontal Wireline and Allied Wireline, Invalidity Contentions in Litigation re Schlumberger SafeJet System vs. Asserted Claims of U.S. Pat. No. 10,844,697, dated as early as Aug. 4, 2021, 26 pgs.
Bear MFG, Oso Perf, Horizontal Wireline and Allied Wireline, Invalidity Contentions in Litigation re U.S. Publication 2012/0199352 to Lanclos vs. Asserted Claims of U.S. Pat. No. 10,844,697, dated as early as Aug. 4, 2021, 24 pgs.
Bear MFG, Oso Perf, Horizontal Wireline and Allied Wireline, Invalidity Contentions in Litigation re U.S. Publication No. 2008/0073081 to Frazier, et al vs. Asserted Claims of U.S. Pat. No. 10,844,697, dated as early as Aug. 4, 2021, 33 pgs.
Bear MFG, Oso Perf, Horizontal Wireline and Allied Wireline, Invalidity Contentions in Litigation re U.S. Publication No. 2016/0084048 to Harrigan, et al vs. Asserted Claims of U.S. Pat. No. 10,844,697, dated as early as Aug. 4, 2021, 14 pgs.
Bear MFG, Oso Perf, Horizontal Wireline and Allied Wireline, Invalidity Contentions in Litigation re U.S. Publication No. 2010/0065302 to Nesbitt vs. Asserted Claims of U.S. Pat. No. 10,844,697, dated as early as Aug. 4, 2021, 15 pgs.
Bear MFG, Oso Perf, Horizontal Wireline and Allied Wireline, Invalidity Contentions in Litigation re U.S. Pat. No. 3,173,992 to Boop vs. Asserted Claims of U.S. Pat. No. 10,844,697, dated as early as Aug. 4, 2021, 17 pgs.
Bear MFG, Oso Perf, Horizontal Wireline and Allied Wireline, Invalidity Contentions in Litigation re U.S. Pat. No. 4,457,383 to Boop. vs. Asserted Claims of U.S. Pat. No. 10,844,697, dated as early as Aug. 4, 2021, 22 pgs.
Bear MFG, Oso Perf, Horizontal Wireline and Allied Wireline, Invalidity Contentions in Litigation re U.S. Pat. No. 6,582,251 to Burke, et al vs. Asserted Claims of U.S. Pat. No. 10,844,697, dated as early as Aug. 4, 2021, 15 pgs.
Bear MFG, Oso Perf, Horizontal Wireline and Allied Wireline, Invalidity Contentions in Litigation re U.S. Pat. No. 7,762,331 to Goodman vs. Asserted Claims of U.S. Pat. No. 10,844,697, dated as early as Aug. 4, 2021, 28 pgs.
Bear MFG, Oso Perf, Horizontal Wireline and Allied Wireline, Invalidity Contentions in Litigation re U.S. Pat. No. 7,901,247 to Ring vs. Asserted Claims of U.S. Pat. No. 10,844,697, dated as early as Aug. 4, 2021, 19 pgs.
Bear MFG, Oso Perf, Horizontal Wireline and Allied Wireline, Invalidity Contentions in Litigation re U.S. Pat. No. 8,387,533 to Runkel vs. Asserted Claims of U.S. Pat. No. 10,844,697, dated as early as Aug. 4, 2021, 16 pgs.
Bear MFG, Oso Perf, Horizontal Wireline and Allied Wireline, Invalidity Contentions in Litigation re U.S. Pat. No. 8,869,887 to Deere, et al vs. Asserted Claims of U.S. Pat. No. 10,844,697, dated as early as Aug. 4, 2021, 10 pgs.
Bear MFG, Oso Perf, Horizontal Wireline and Allied Wireline, Invalidity Contentions in Litigation re U.S. Pat. No. 8,943,943 to Tassaroli vs. Asserted Claims of U.S. Pat. No. 10,844,697, dated as early as Aug. 4, 2021, 7 pgs.
Bear MFG, Oso Perf, Horizontal Wireline and Allied Wireline, Invalidity Contentions in Litigation re U.S. Pat. No. 9,065,201 to Borgfeld, et al. vs. Asserted Claims of U.S. Pat. No. 10,844,697, dated as early as Aug. 4, 2021, 14 pgs.
Bear MFG, Oso Perf, Horizontal Wireline and Allied Wireline, Invalidity Contentions in Litigation re U.S. Pat. No. 9,145,764 to Burton, et al. vs. Asserted Claims of U.S. Pat. No. 10,844,697, dated as early as Aug. 4, 2021, 18 pgs.
Bear MFG, Oso Perf, Horizontal Wireline and Allied Wireline, Invalidity Contentions in Litigation re U.S. Pat. No. 9,689,223 to Schacherer, et al vs. Asserted Claims of U.S. Pat. No. 10,844,697, dated as early as Aug. 4, 2021, 8 pgs.
Brazilian Patent and Trademark Office; Search Report for BR Application No. BR112015033010-0; dated May 5, 2020; (4 pages).
Brinsden, Mark; Declaration of Mark Brinsden; dated Sep. 30, 2021; 51 pages.
Buche & Associates, P.C.; Rule 501 Citation of Prior Art and Written "Claim Scope Statements" in U.S. Pat. No. 10,844,697; dated Mar. 3, 2021; 24 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
C&J Energy Services; Gamechanger Perforating System Description; 2018; 1 pages.
C&J Energy Services; Gamechanger Perforating System Press Release; 2018; 4 pages.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Canadian Intellectual Property Office; Office Action for CA Application No. 2,941,648; dated Mar. 15, 2021; 3 pages.
Canadian Intellectual Property Office; Office Action for CA Application No. 3,015,102; dated Feb. 4, 2022; 3 pages.
Canadian Intellectual Property Office; Office Action for CA Application No. 3,070,118; dated Mar. 16, 2021; 3 pages.
Canadian Intellectual Property Office; Office Action for CA Application No. 3,070,118; dated Nov. 17, 2021; 3 pages.
Canadian Intellectual Property Office; Office Action for CA Application No. 3040648; dated Nov. 18, 2020; 4 pages.

(56) References Cited

OTHER PUBLICATIONS

ControlFire User Manual; Exhibit No. 2005 of PGR No. 2020-00072; 2014; 56 pages.
Corelab Owen Oil Tools; Expendable Perforating Guns Description; https://www.corelab.com/owen/cms/docs/Canada/10A_erhsc-01.0-c.pdf; 2008; 7 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Djresource, Replacing Signal and Ground Wire, May 1, 2007, 2 pages, http://www.djresource.eu/Topics/story/110/Technics-SL-Replacing-Signal-and-Ground-Wire/.
drillingmatters.org; Definition of "sub"; dated Aug. 25, 2018; 2 pages.
Dynaenergetics Europe GMBH, OSO Perforating, LLC, SWM International, LLC and Bear Manufacturing, LLC; Joint Claim Construction Statement for Northern District of Texas Civil Action Nos. 3:21-cv-00188, 3:21-cv-00192 and 3:21-cv-00185; dated Sep. 28, 2021; 29 pages.
Nextier Completion Solutions Inc.; Exhibit A-9 Selective perforation: A Game Changer in Peforating Technology—Case Study; dated Aug. 30, 2021; 13 pages.
Nextier Completion Solutions; Plaintiffs Preliminary Invalidity Contentions for Civil Action No. 4:21-cv-01328; dated Jun. 30, 2021; 19 pages.
Nextier Oilfield Solutions Inc; Petition for Inter Partes Review No. IPR2021-00082; dated Oct. 21, 2020; 111 pages.
Nexus Perforating LLC; Answer to DynaEnergetics Europe GMBH and DynaEnergetics US Inc/'s Complaint and Counterclaims; dated Apr. 15, 2021; 10 pages.
Nexus Perforating LLC; Complaint and Demand for Jury Trial for Civil Case No. 4:20-cv-01539; dated Apr. 30, 2020; 11 pages.
Nexus Perforating LLC; Invalidity Contentions for Civil Action No. 4:21-cv-00280; dated Jun. 30, 2021; 44 pages.
Nexus Perforating LLC; Nexus Perforating LLC's Responsive Claim Construction Brief for Civil Action No. 4:21-cv-00280; dated Nov. 3, 2021; 31 pages.
Nexus Perforating LLC; Nexus Preliminary Claim Construction and Extrinsic Evidence for Civil Action No. 4:21-cv-00280; dated Aug. 4, 2021; 6 pages.
Norwegian Industrial Property Office; Notice of Allowance for NO Application No. 20171759; dated Apr. 23, 2021; 2 pages.
Norwegian Industrial Property Office; Office Action and Search Report for NO App. No. 20160017; dated Jun. 15, 2017; 5 pages.
Norwegian Industrial Property Office; Office Action and Search Report for NO App. No. 20171759; dated Jan. 14, 2020; 6 pages.
Norwegian Industrial Property Office; Office Action for NO Appl. No. 20160017; dated Dec. 4, 2017; 2 pages.
Norwegian Industrial Property Office; Office Action for NO Appl. No. 20171759; dated Oct. 30, 2020; 2 pages.
Norwegian Industrial Property Office; Office Action for NO Application No. 20210799; dated Oct. 30, 2021; 2 pages.
Norwegian Industrial Property Office; Opinion for NO Appl. No. 20171759; dated Apr. 5, 2019; 1 page.
Oilfield Glossary; Definition of Perforating Gun; dated Feb. 26, 2013; 2 pages.
oilgasglossary.com; Definition of "sub"; dated Nov. 20, 2008; 1 page.
Olsen, Steve; Declaration regarding the SafeJet System for PGR2021-00097; dated Jul. 16, 2021; 25 pages.
Oso Perforating, LLC; Defendant's Preliminary Invalidity Contentions for Civil Action No. 3:21-cv-00188-M; dated Aug. 4, 2021; 23 pages.
Oso Perforating, LLC; Exhibit A1 U.S. Pat. No. 5,155,293 to Barton vs. Asserted Claims of U.S. Pat. No. 10,844,697; dated Aug. 4, 2021; 21 pages.
Owen Oil Tools & Pacific Scientific; RF-Safe Green Det, Side Block for Side Initiation, Jul. 26, 2017, 2 pgs.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
Parrott, Robert; Declaration for IPR2021-00082; dated Oct. 20, 2020; 110 pages.
Parrott, Robert; Declaration for PGR No. 2021-00078; dated May 10, 2021; 182 pages.
Patent Trial and Appeal Board; Decision Granting Patent Owner's Request for Rehearing and Motion to Amend for IPR2018-00600; dated Jul. 6, 2020; 27 pages.
Patent Trial and Appeals Board; Decision Granting Institution of Post Grant Review, PGR No. PGR2021-00097; dated Jan. 6, 2022; 92 pages.
PCT Search Report and Written Opinion, dated May 4, 2015: See Search Report and Written opinion for PCT Application No. PCT/EP2014/065752, 12 pgs.
PerfX Wireline Services, LLC; PerfX Wireline Services, LLC's Preliminary Invalidity Contentions for Civil Action No. 1:20-CV-03665; dated Jul. 2, 2021; 4 pages.
PerfX Wireline Services, LLC; Defendant PerfX Wireline Services, LLC's Opening Claim Construction Brief; dated Oct. 18, 2021; 23 pages.
Perfx Wireline Services, LLC; Invalidity Chart for U.S. Pat. No. 10,844,697 in view of the Dynawell Gun System Exhibit A; dated Jul. 2, 2021; 42 pages.
Perfx Wireline Services, LLC; Invalidity Chart for U.S. Pat. No. 10,844,697 in view of the LRI Gun System Exhibit B; dated Jul. 2, 2021; 33 pages.
Perfx Wireline Services, LLC; Invalidity Chart for U.S. Pat. No. 10,844,697 in view of the Owen Oil Tools System Exhibit C; dated Jul. 2, 2021; 64 pages.
Perfx Wireline Services, LLC; Invalidity Chart for U.S. Pat. No. 10,844,697 in view of the Select Fire System Exhibit D; dated Jul. 2, 2021; 49 pages.
Perfx Wireline Services, LLC; Invalidity Chart for U.S. Pat. No. 10,844,697 in view of U.S. Pat. No. 10,077,641 Exhibit H; dated Jul. 2, 2021; 41 pages.
Perfx Wireline Services, LLC; Invalidity Chart for U.S. Pat. No. 10,844,697 in view of U.S. Pat. No. 4,007,796 Exhibit F; dated Jul. 2, 2021; 40 pages.
Perfx Wireline Services, LLC; Invalidity Chart for U.S. Pat. No. 10,844,697 in view of U.S. Pat. No. 5,042,594 Exhibit E; dated Jul. 2, 2021; 38 pages.
Perfx Wireline Services, LLC; Invalidity Chart for U.S. Pat. No. 10,844,697 in view of U.S. Pat. No. 9,145,764 Exhibit G; dated Jul. 2, 2021; 58 pages.
Perfx's Wireline Services, LLC; Exhibit A-1: Invalidity Chart for U.S. Pat. No. 10,844,697 in view of the Dynawell Gun System; dated Aug. 30, 2021; 30 pages.
Perfx's Wireline Services, LLC; Exhibit A-2: Invalidity Chart for U.S. Pat. No. 10,844,697 in view of the LRI Gun System; dated Aug. 30, 2021; 29 pages.
Perfx's Wireline Services, LLC; Exhibit A-3: Invalidity Chart for U.S. Pat. No. 10,844,697 in view of the Owen Oil Tools System; dated Aug. 30, 2021; 42 pages.
Perfx's Wireline Services, LLC; Exhibit A-4: Invalidity Chart for U.S. Pat. No. 10,844,697 in view of the Select Fire System; dated Aug. 30, 2021; 32 pages.
Perfx's Wireline Services, LLC; Exhibit A-5: Invalidity Chart for U.S. Pat. No. 10,844,697 in view of U.S. Pat. No. 5,042,594; dated Aug. 30, 2021; 27 pages.

(56) References Cited

OTHER PUBLICATIONS

Perfx's Wireline Services, LLC; Exhibit A-6: Invalidity Chart for U.S. Pat. No. 10,844,697 in view of U.S. Pat. No. 4,007,796; dated Aug. 30, 2021; 23 pages.
Perfx's Wireline Services, LLC; Exhibit A-7: Invalidity Chart for U.S. Pat. No. 10,844,697 in view of U.S. Pat. No. 9,145,764; dated Aug. 30, 2021; 36 pages.
Perfx's Wireline Services, LLC; Exhibit A-8: Invalidity Chart for U.S. Pat. No. 10,844,697 in view of U.S. Pat. No. 10,077,6414; dated Aug. 30, 2021; 29 pages.
Perfx's Wireline Services, LLC; Exhibit A-9: Invalidity Chart for U.S. Pat. No. 10,844,697 in view of the SafeJet System; dated Aug. 30, 2021; 18 pages.
Perfx's Wireline Services, LLC; Exhibit B-1: Invalidity Chart for U.S. Pat. No. D. 904,475 in view of the Dynawell Tandem Sub; dated Aug. 30, 2021; 10 pages.
Perfx's Wireline Services, LLC; Exhibit B-2: Invalidity Chart for U.S. Pat. No. D. 904,475 in view of the LRI Tandem Subassembly; dated Aug. 30, 2021; 12 pages.
Perfx's Wireline Services, LLC; Exhibit B-3: Invalidity Chart for U.S. Pat. No. D. 904,475 in view of the Owen Oil Tools Tandem Sub; dated Aug. 30, 2021; 10 pages.
Perfx's Wireline Services, LLC; Exhibit B-4: Invalidity Chart for U.S. Pat. No. D. 904,475 in view of the XConnect Tandem Sub; dated Aug. 30, 2021; 1 page.
Perfx's Wireline Services, LLC; Exhibit B-5: Invalidity Chart for U.S. Pat. No. D. 904,475 in view of the SafeJet Disposable Bulkhead; dated Aug. 30, 2021; 15 pages.
Perfx's Wireline Services, LLC; Exhibit B-6: Invalidity Chart for U.S. Pat. No. D. 904,475 in view of Chinese Patent Application No. CN110424930A; dated Aug. 30, 2021; 9 pages.
Perfx's Wireline Services, LLC; Exhibit B-7: Invalidity Chart for U.S. Pat. No. D. 904,475 in view of U.S. Patent Publication No. 2020/0308938; dated Aug. 30, 2021; 8 pages.
Perfx's Wireline Services, LLC; Xconnect, LLC's Preliminary Invalidity Contentions for Civil Action No. 6:21-cv-00371-ADA; dated Aug. 30, 2021; 7 pages.
Preiss Frank et al.; Lowering Total Cost of Operations Through Higher Perforating Efficiency while simultaneously enhancing safety; May 10, 2016; 26 pages.
Promperforator LLC, Perforating Systems Design and Manufacturing, 2014, 36 pgs., http://www.promperforator.ru/upload/file/katalog_eng_2014.pdf.
Repeat Precision, LLC; Plaintiff Repeat Precision, LLC's Responsive Claim Construction Brief for Civil Action No. 6:21-cv-104-ADA, Public Version; dated Oct. 27, 2021; 21 pages.
Resilience Against Market Volatility Results Presentation; Exhibit 2015 of PGR No. 2020-00080; dated Jun. 30, 2020; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Claim Construction Declaration for Civil Action No. 3:21-cv-00185; dated Sep. 28, 2021; 41 pages.
Rodgers, John; Claim Construction Declaration for Civil Action No. 3:21-cv-00188; dated Sep. 28, 2021; 42 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Rodgers, John; Declaration for PGR2021-00078; dated Aug. 19, 2021; 137 pages.
Rodgers, John; Declaration of John Rodgers, Ph.D for PGR Case No. PGR2021-00097; dated Oct. 28, 2021; 124 pages.
Rodgers, John; Videotaped Deposition of John Rodgers; dated Jul. 29, 2021; 49 pages.
Salt Warren et al.; New Perforating Gun System Increases Safety and Efficiency; dated Apr. 1, 2016; 11 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger Technology Corporation, Defendant Schlumberger Technology Corporation's Opening Claim Construction Brief for Civil Action No. 6:21-cv-00225-ADA; dated Oct. 6, 2021; 27pages.
Schlumberger Technology Corporation; Defendant Schlumberger Technology Corporation'S Reply to Plaintiffs' Responsive Claim Construction Brief; dated Nov. 10, 2021; 17 pages.
Schlumberger Technology Corporation; Petitioner's Reply to Patent Owner's Preliminary Response; dated Oct. 13, 2021; 14 pages.
Schlumberger; Field Test Database Print Out Showing uses of the SafeJet System; dated May 11, 2015; 10 pages.
Schlumberger; Lina Pradilla, Wireline Efficiency in Unconventional Plays—The Argentinean Experience, including excerpted image from slide 13; dated 2013; 16 pages http://www.perforators.org/wp-content/uploads/2015/10/SLAP_47_Wireline_Efficiency_Unconventional_Plays.pdf.
Schlumberger; Selective Perforation: A Game Changer in Perforating Technology—Case Study; issued 2012; 14 pages.
Sharma, Gaurav; Hunting Plc Is Not In A Race To The Bottom, Says Oilfield Services Firm's CEO; dated Sep. 10, 2019; retrieved on Nov. 18, 2020; 6 pages.
Shelby Sullivan; Declaration of Shelby Sullivan; dated Oct. 18, 2021; 9 pages.
SIPO, Search Report dated Mar. 29, 2017, in Chinese: See Search Report for CN App. No. 201480040456.9, 12 pgs. (English Translation 3 pgs.).
Smithson, Anthony; Declaration Declaration for IPR2021-00082; dated Oct. 16, 2020; 2 pages.
Smylie, Tom, New Safe and Secure Detonators for the Industry's consideration, presented at Explosives Safety & Security Conference, Marathon Oil Co, Houston; Feb. 23-24, 2005, 20 pages.
State Intellectual Property Office People's Republic of China; First Office Action for Chinese App. No. 201811156092.7; dated Jun. 16, 2020; 6 pages (Eng Translation 8 pages).
State Intellectual Property Office, P.R. China; First Office Action for Chinese App No. 201580011132.7; dated Jun. 27, 2018; 5 pages (Eng. Translation 9 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Notification to Grant Patent Right for CN App. No. 201480040456.9; dated Jun. 12, 2018; 2 pages (English translation 2 pages).
State Intellectual Property Office, P.R. China; Second Office Action for CN App. No. 201480040456.9; dated Nov. 29, 2017; 5 pages (English translation 1 page).
State Intellectual Property Office, P.R. China; Second Office Action for CN App. No. 201480047092.7; dated Jan. 4, 2018; 3 pages.
Stifel; Why the Big Pause? Balancing Long-Term Value with Near-Term Headwinds. Initiating Coverage of Oilfield Svcs and Equipment; dated Sep. 10, 2018; 207 pages.
SWM International, LLC and Nextier Completion Solutions LLC; Petitioner's Preliminary Reply to Patent Owner's Preliminary Response for Case No. PGR2021-00097; dated Nov. 15, 2021; 11 pages.

(56) References Cited

OTHER PUBLICATIONS

SWM International, LLC and Nextier Oil Completion Solutions, LLC; Petition for Post Grant Review PGR No. 2021-00097; dated Jul. 20, 2021; 153 pages.
SWM International, LLC; Defendant's P.R. 3-3 and 3-4 Preliminary Invalidity Contentions; dated Aug. 4, 2021; 28 pages.
Hunting Titan, Inc.; Defendant Hunting Titan, Inc.'s Opposition to Plaintiffs Motion for Summary Judgement for Civil Action No. 4:20-cv-02123; dated Mar. 30, 2022; 37 pages.
Hunting Titan, Inc.; Defendant Hunting Titan, Inc.'s Opposed Motion for Leave to Amend Invalidity Contentions for Civil Action No. 4:20-cv-02123; dated Nov. 19, 2021; 17 pages.
Hunting Titan, Inc.; Defendant's Final Invalidity Contentions for Civil Action No. 4:20-cv-02123; dated Jan. 7, 2022; 54 pages.
Hunting Titan, Inc.; Defendant's Preliminary Invalidity Contentions for Civil Action No. 4:20-cv-02123; dated Aug. 6, 2021; 52 pages.
Hunting Titan, Inc.; Exhibit 1 to Defendant Hunting Titan, Inc.'s Opposed Motion for Leave to Amend Invalidity Contentions for Civil Action No. 4:20-cv-02123; dated Nov. 19, 2021; 64 pages.
Hunting Titan, Inc.; Exhibit 2 to Defendant Hunting Titan, Inc.'s Opposed Motion for Leave to Amend Invalidity Contentions for Civil Action No. 4:20-cv-02123; dated Nov. 19, 2021; 33 pages.
Hunting Titan, Inc.; Exhibit 3 to Defendant Hunting Titan, Inc.'s Opposed Motion for Leave to Amend Invalidity Contentions for Civil Action No. 4:20-cv-02123; dated Nov. 19, 2021; 24 pages.
Hunting Titan, Inc.; Exhibit 4 to Defendant Hunting Titan, Inc.'s Opposed Motion for Leave to Amend Invalidity Contentions for Civil Action No. 4:20-cv-02123; dated Nov. 19, 2021; 9 pages.
Hunting Titan, Inc.; Exhibit 5 to Defendant Hunting Titan, Inc.'s Opposed Motion for Leave to Amend Invalidity Contentions for Civil Action No. 4:20-cv-02123; dated Nov. 19, 2021; 5 pages.
Hunting Titan, Inc.; Exhibit 6 to Defendant Hunting Titan, Inc.'s Opposed Motion for Leave to Amend Invalidity Contentions for Civil Action No. 4:20-cv-02123; dated Nov. 19, 2021; 4 pages.
Hunting Titan, Inc.; Exhibit 7 to Defendant Hunting Titan, Inc.'s Opposed Motion for Leave to Amend Invalidity Contentions for Civil Action No. 4:20-cv-02123; dated Nov. 19, 2021; 6 pages.
Hunting Titan, Inc.; Exhibit A to Defendant's Preliminary Invalidity Contentions, Invalidity of U.S. Pat. No. 10,429,161; dated Aug. 6, 2021; 93 pages.
Hunting Titan, Inc.; Exhibit B to Defendant's Preliminary Invalidity Contentions, Invalidity of U.S. Pat. No. 10,472,938; dated Aug. 6, 2021; 165 pages.
Hunting Titan, Inc.; Exhibit C to Defendant's Final Invalidity Contentions, Invalidity of U.S. Pat. No. 10,429,161; dated Jan. 7, 2022; 3 pages.
Hunting Titan, Inc.; Exhibit D to Defendant's Final Invalidity Contentions, Invalidity of U.S. Pat. No. 10,472,938; dated Jan. 7, 2022; 6 pages.
United States District Court for the Northern District of Texas Dallas Division; Memorandum Opinion and Order in Civil Action No. 3:21-cv-00192-M; Mar. 23, 2022; 34 pages (order is redacted to protect confidential information; redacted order has not yet been filed by the Court).
United States District Court for the Northern District of Texas Dallas Division; Memorandum Opinion and Order in Civil Action No. 3:21-cv-00188-M; Mar. 23, 2022; 35 pages (order is redacted to protect confidential information; redacted order has not yet been filed by the Court).
United States Patent and Trademark Office; Non-Final Office Action for U.S. Appl. No. 17/007,574; dated May 6, 2022; 10 pages.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Pat. No. 438305A, issued on Oct. 14, 1890 to T.A. Edison, 2 pages.
United States Patent and Trademark Office; Final Office Action of U.S. Appl. No. 16/809,729, dated Nov. 3, 2020; 19 pages.
United States Patent and Trademark Office; Decision Granting Institution of Post-Grant Review 35 U.S.C. § 324 for PGR2021-00078; dated Nov. 1, 2021; 87 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/004,966; dated Mar. 12, 2021; 18 pages.
United States Patent and Trademark Office; Final Office Action for U.S. Appl. No. 17/352,728; dated Mar. 9, 2022; 9 pages.
United States Patent and Trademark Office; Final Office Action of U.S. Appl. No. 16/540,484; dated Mar. 30, 2020; 12 pgs.
United States Patent and Trademark Office; Information Disclosure Statement for U.S. Appl. No. 16/293,508; dated Dec. 10, 2020; 7 pages.
United States Patent and Trademark Office; Non-Final Office Action for U.S. Appl. No. 16/542,890; dated Nov. 4, 2019; 16 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/540,484; dated Aug. 9, 2021; 12 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/181,280; dated Apr. 19, 2021; 18 pages.
United States Patent and Trademark Office; Non-Final Office Action for U.S. Appl. No. 17/206,416; dated May 19, 2021; 10 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 9 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 29/733,080; dated Oct. 20, 2020; 9 pages.
United States Patent and Trademark Office; Notice of Allowance for U.S. Appl. No. 16/858,041; dated Oct. 22, 2020; 10 pages.
United States Patent and Trademark Office; Notice of Allowance for U.S. Appl. No. 29/733,325; dated Oct. 23, 2020; 7 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 15/920,812; dated Aug. 4, 2021; 5 pages.
United States Patent and Trademark Office; Notice of Allowance for U.S. Appl. No. 16/379,341; dated Jan. 19, 2021; 8 pages.
United States Patent and Trademark Office; Notice of Allowance for U.S. Appl. No. 16/423,789; dated Jul. 23, 2020 7 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 16/819,270; dated Oct. 22, 2021; 7 pages.
United States Patent and Trademark Office; Notice of Allowance for U.S. Appl. No. 17/007,574; dated May 21, 2021; 8 pages.
United States Patent and Trademark Office; Notice of Allowance for U.S. Appl. No. 17/221,219; dated Jan. 13, 2022; 11 pages.

(56) References Cited

OTHER PUBLICATIONS

United States Patent and Trademark Office; Notices of Allowabilty for U.S. Appl. No. 16/585,790; dated Jul. 31, 2020 and dated Mar. 18, 2020; Response to Office Action for U.S. Appl. No. 16/585,790; dated Nov. 12, 2019; 26 pages.
United States Patent and Trademark Office; Office Action and Response to Office Action for U.S. Appl. No. 16/585,790; dated Nov. 12, 2019 and dated Feb. 12, 2020; 21 pages.
United States Patent and Trademark Office; Office Action for U.S. Appl. No. 17/004,966; dated Dec. 8, 2020; 30 pages.
United States Patent and Trademark Office; Office Action in Ex Parte Reexamination for U.S. Pat. No. 10,844,697; dated Jan. 26, 2022; 10 pages.
United States Patent and Trademark Office; Office Action of U.S. Appl. No. 16/540,484, dated Aug. 20, 2020, 10 pgs.
United States Patent and Trademark Office; Order Granting Request for Ex Parte Reexamination; dated Nov. 1, 2021; 14 pages.
United States Patent and Trademark Office; Patent Assignment for U.S. Appl. No. 61/733,129; dated Jan. 25, 2013; 2 pages.
United States Patent and Trademark Office; Prosecution History for U.S. Pat. No. 10,352,136 as of Jul. 16, 2019; 206 pages.
United States Patent and Trademark Office; U.S. Appl. No. 61/739,592; dated Dec. 19, 2012; 65 pages.
SWM International, LLC; Defendant's P.R. 4-1 Disclosure of Proposed Terms and Claim Elements for Construction for Civil Action No. 3:21-cv-00192-M; dated Aug. 24, 2021; 5 pages.
SWM International, LLC; Ex. A-1 Invalidity of U.S. Pat. No. 10,844,697 Over the SafeJet System; dated Aug. 4, 2021; 15 pages.
SWM International, LLC; Ex. A-1 A Invalidity of U.S. Pat. No. 10,844,697 Over the SafeJet System in view of Backhus; dated Aug. 4, 2021; 4 pages.
SWM International, LLC; Ex. A-1B Invalidity of U.S. Pat. No. 10,844,697 Over the SafeJet System in view of Harrigan; dated Aug. 4, 2021; 3 pages.
SWM International, LLC; Ex. A-2 Invalidity of U.S. Pat. No. 10,844,697 Over Goodman; dated Aug. 4, 2021; 11 pages.
SWM International, LLC; Ex. A-2A Invalidity of U.S. Pat. No. 10,844,697 Over Goodman in view of Backhus; dated Aug. 4, 2021; 3 pages.
SWM International, LLC; Ex. A-2B Invalidity of U.S. Pat. No. 10,844,697 Over Goodman in view of Harrigan; dated Aug. 4, 2021; 3 pages.
SWM International, LLC; Ex. A-3 Invalidity of U.S. Pat. No. 10,844,697 Over Harrigan; dated Aug. 4, 2021; 13 pages.
SWM International, LLC; Ex. A-4 Invalidity of U.S. Pat. No. 10,844,697 Over Burton; dated Aug. 4, 2021; 11 pages.
SWM International, LLC; Ex. A-5 Invalidity of U.S. Pat. No. 10,844,697 Over Rogman; dated Aug. 4, 2021; 10 pages.
SWM International; Drawing of SafeJet System; dated Jul. 20, 2021; 1 page.
SWM International; Photographs of SafeJet System; dated Jul. 20, 2021; 9 pages.
TOLTEQ; iSeries MWD System; dated 2021; 9 pages.
U.S. Patent Trial and Appeal Board, Institution of Inter Partes Review of U.S. Pat. No. 9581422, Case IPR2018-00600,Aug. 21, 2018, 9 pages.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States District Court for the Southern District of Texas; Joint Claim Construction Statement for Civil Action No. 3:20-cv-00376; dated Jul. 8, 2021; 14 pages.
United States District Court for the Southern District of Texas; Joint Claim Construction Statement for Civil Action No. 4:20-cv-02123; dated Aug. 27, 2021; 14 pages.
United States District Court for the Western District of Texas; Order Granting in Part & Denying on Part Defendants' Motion to Dismiss for Improper Venue or to Transfer Venue Pursuant to 28 U.S.C. § 1404(a) for Civil Action No. 6:20-CV-01110-ADA; dated Aug. 5, 2021; 16 pages.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/359,540, dated May 3, 2019, 11 pages.

(56) References Cited

OTHER PUBLICATIONS

United States Patent and Trademark Office, Non-Final Office Action of U.S. Appl. No. 16/455,816, dated Nov. 5, 2019, 17 pages.
United States Patent and Trademark Office, Notice of Allowance for U.S. Appl. No. 15/920,800, dated Jul. 7, 2020, 7 pages.
United States Patent and Trademark Office, Notice of Allowance for U.S. Appl. No. 16/585,790, dated Jun. 19, 2020, 16 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
Dynaenergetics Europe GMBH; Complaint and Demand for Jury Trial for Civil Action No. 4:21-cv-00280; dated Jan. 28, 2021; 55 pages.
Dynaenergetics Europe GMBH; Patent Owner's Preliminary Response for PGR2020-00072; dated Oct. 23, 2020; 108 pages.
Dynaenergetics Europe GMBH; Patent Owner's Preliminary Response for PGR2020-00080; dated Nov. 18, 2020; 119 pages.
Dynaenergetics Europe GMBH; Patent Owner's Preliminary Response for PGR2021-00078; dated Aug. 19, 2021; 114 pages.
Dynaenergetics Europe GMBH; Plaintiff's Preliminary Infringement Contentions for Civil Action No. 6:21-cv-01110; dated Jul. 6, 2021; 6 pages.
Dynaenergetics Europe GMBH; Principal and Response Brief of Cross-Appellant for United States Court of Appeals case No. 2020-2163, -2191; dated Jan. 11, 2021; 95 pages.
Dynaenergetics Europe GMBH; Reply Under 37 C.F.R. §1.111 Amendment Under 37 C.F.R. §1.121 for U.S. Appl. No. 16/585,790; dated Feb. 20, 2020; 18 pages.
DynaEnergetics Europe, GMBH; DynaEnergetics' Preliminary Claim Construction and Extrinsic Evidence for Civil Action No. 4:21-cv-00280; dated Aug. 4, 2021; 10 pages.
Dynaenergetics Europe, GMBH; Patent Owner's Preliminary Response for PGR No. 2021-00097; dated Oct. 29, 2021; 110 pages.
Dynaenergetics Europe; Defendants' Preliminary Infringement Contentions for Civil Action No. 3:20-CV-00376; dated Mar. 25, 2021; 22 pages.
DynaEnergetics Europe; DynaEnergetics Celebrates Grand Opening of DynaStage Manufacturing and Assembly Facilities in Blum, Texas; dated Nov. 16, 2018; 3 pages.
DynaEnergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
Dynaenergetics Europe; Exhibit B Invalidity Claim Chart for Civil Action No. 4:19-cv-01611; dated May 2, 2019; 52 pages.
Dynaenergetics Europe; Petition to Correct Inventorship in Patent under 37 C.F.R § 1.324; dated Oct. 13, 2020; 21 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Pending Motion For Reconsideration for Civil Action No. 4:17-cv-03784; dated Jan. 21, 2021; 4 pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiff's Preliminary Infringment Contentions Civil Action No. 3:21-cv-00192-M; dated Jun. 18, 2021; 15 pages.
Dynaenergetics Europe; Plaintiffs' Reply in Support of Motion to Dismiss and Strike for Civil Action No. 6:20-cv-00069-ADA; dated Apr. 29, 2020; 15 pages.
Dynaenergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
Dynaenergetics Europe; Plaintiffs' Response to Defendants' Answer to Second Amended Complaint Civil Action No. 6:20-cv-00069-ADA; dated May 26, 2020; 18 pages.
DynaEnergetics exhibition and product briefing; Exhibit 2006 of PGR No. 2020-00072; dated 2013; 15 pages.
Dynaenergetics GMBH & Co. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, No Debris Gun System (NDG), Hamburg, Germany, Feb. 6, 2008, 26 pgs.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Dynaenergetics; DynaStage Solution—Factory Assembled Performance-Assured Perforating Systems; 6 pages.
DynaStage Gun System; Exhibit 2009 of PGR No. 2020-00080; dated May 2014; 2 pages.
Entchev et al., Autonomous Perforating System for Multizone Completions, SPE International, 2011, 7 pgs., https://www.onepetro.org/conference-paper/SPE-147296-MS.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Fayard, Alfredo; Declaration of Alfredo Fayard; dated Oct. 18, 2021; 13 pages.
Federal Institute of Industrial Property; Decision of Granting for RU Appl. No. 2016104882/03(007851); dated May 17, 2018; 15 pages (English translation 4 pages).
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
G&H Diversified Manufacturing LP; Petition for Post Grant Review PGR No. 2021-00078; dated May 10, 2021; 122 pages.
G&H Diversified Manufacturing, LP and Dynaenergetics Europe GMBH; Joint Claim Construction Statement for Civil Action No. 3:20-cv-00376; dated Jul. 8, 2021; 14 pages.
G&H Diversified Manufacturing, LP; Defendant G&H Diversified Manufacturing, LP's Answer to Counter-Claim Plaintiffs' Counter-Claims for Civil Action No. 3:20-cv-00376; dated Apr. 19, 2021; 13 pages.

(56) References Cited

OTHER PUBLICATIONS

G&H Diversified Manufacturing, LP; Defendant G&H Diversified Manufacturing, LP's Opening Claim Construction Brief; dated Oct. 18, 2021; 25 pages.
G&H Diversified Manufacturing, LP; Defendants' Preliminary Invalidity Contentions for Civil Action No. 3:20-cv-00376; dated May 6, 2021; 20 pages.
G&H Diversified Manufacturing, LP; Petitioner's Oral Argument Presentation for PGR No. PGR2021-00078; dated Jul. 26, 2022; 65 pages.
International Searching Authority; International Search Report and Written Opinion of the International Searching Authority for PCT/EP2022/055192; dated May 16, 2022; 15 pages.
SWM International, LLC and Nextier Completion Solutions Inc; Petitioner's Reply to Patent Owner's Response to Petition for Case No. PGR2021-00097; dated Jul. 29, 2022; 36 pages.

BULKHEAD

CROSS-REFERENCE TO RELATED APPLICATIONS

This application claims the benefit of U.S. Provisional Patent Application No. 63/155,902 filed Mar. 3, 2021, the entire contents of which are incorporated herein by reference.

BACKGROUND OF THIS DISCLOSURE

Bulkheads may be used in wellbore tool strings to provide electrical connection between segments of the perforating tool string, and they may also provide a seal against fluid and/or pressure between segments of the wellbore tool string.

Exemplary embodiments of bulkheads may use sealing elements, such as O-rings that are provided on either or both of an interior conductive body and an exterior bulkhead body, or bulkhead covers formed of a material capable of creating a fluid and/or pressure seal. However, reliance on multiple sealing elements can increase the possible points of failure from a hydraulic sealing point of view. Further, reliance on the bulkhead cover for pressure and/or fluid sealing limits the range of materials that can be used, therefore increasing manufacturing costs.

In order to reduce manufacturing costs and improve performance reliability, there may be a need for a simplified bulkhead requiring less material and/or parts, as well as less expensive manufacturing methods for the constituent parts, while still allowing ease of use of the device in practical application. Additionally, in order to improve reliability of the wellbore tool string, there may be a need for a bulkhead with dampening and/or shock absorption features to reduce damage to the wellbore perforating tool string and maintain electrical communication during wellbore operations. Further, in order to provide electrical connection to a range of wellbore tools, there may be a need for a bulkhead with a first electrical contact configured for connection to an uphole tool, and a second electrical contact configured for electrical connection to a downhole tool.

BRIEF DESCRIPTION OF THE EXEMPLARY EMBODIMENTS

According to an aspect, the exemplary embodiments include a bulkhead including a fixed body having a first contact surface and an exterior fixed body surface. A seal element may be provided on the exterior fixed body surface. The bulkhead may include a first electrical contact, a first spring having a first spring end in contact with the first contact surface, and a second spring end in contact with the first electrical contact. The bulkhead may further include a first cover having a first large region having a first large region inner diameter and a first small region having a first small region inner diameter, wherein the first large region inner diameter is larger than the first small region inner diameter. The bulkhead fixed body, the first electrical contact, and the first spring may be inserted through the first cover such that the first electrical contact protrudes through the first small region and a portion of the first large region surrounds a first fixed body portion of the fixed body. A first contact maximum outer diameter of the first electrical contact may be larger than the first small region inner diameter of the first small region.

In another aspect, the exemplary embodiments include a bulkhead including a fixed body having an exterior fixed body surface. The bulkhead may further include a first cover having a first large region having a first large region inner diameter and a first small region having a first small region inner diameter, wherein the first large region inner diameter is larger than the first small region inner diameter, and a second cover having a first large region having a first large region inner diameter and a first small region having a first small region inner diameter, wherein the first large region inner diameter is larger than the first small region inner diameter. A seal element may be provided on the exterior fixed body surface in a gap provided between the first cover and the second cover. The bulkhead fixed body may further include a first contact protrusion that extends through the first small region of the first cover, and a second contact protrusion that extends through the second small region of the second cover.

In a further aspect, the exemplary embodiments include a tandem seal adapter (TSA), including a TSA body, a bore extending through the TSA body, and a bulkhead provided within the bore. The bulkhead may include a fixed body having an exterior fixed body surface, a cover surrounding a portion of the fixed body, a first electrical contact extending from a first end of the cover, a second electrical contact extending from a second end of the cover, and a seal element provided on the exterior fixed body surface. There may be one and only one seal element provided on the exterior fixed body surface.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
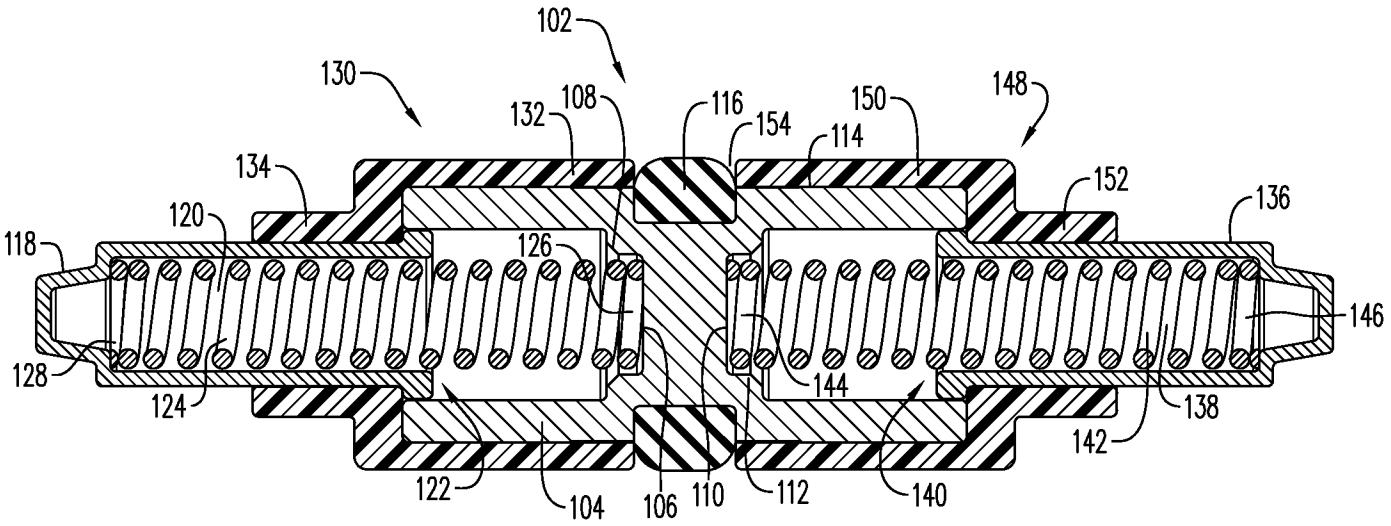
FIG. 1 is a cross section view of a bulkhead according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

DETAILED DESCRIPTION

Reference will now be made in detail to various exemplary embodiments. Each example is provided by way of explanation and is not meant as a limitation and does not constitute a definition of all possible embodiments.

FIG. 1 shows an exemplary embodiment of a bulkhead 102. The bulkhead 102 may include a fixed body 104, a seal element 116, a first electrical contact 118, a second electrical contact 136, a first spring 124, a second spring 142, and a cover (i.e., a first cover 130, and a second cover 148).

The fixed body 104 may be formed of an electrically conductive material and may include a first contact surface 106, a second contact surface 110 opposite to the first contact surface 106, and an exterior fixed body surface 114. The seal element 116 may be provided on the exterior fixed body surface 114. A first chamfered edge 108 may be formed adjacent to the first contact surface 106. Similarly, a second chamfered edge may be provided adjacent to the second contact surface 110. In an exemplary embodiment, the first chamfered edge 108 and the second contact surface 110 may be rounded instead of chamfered.

Figure 1A:
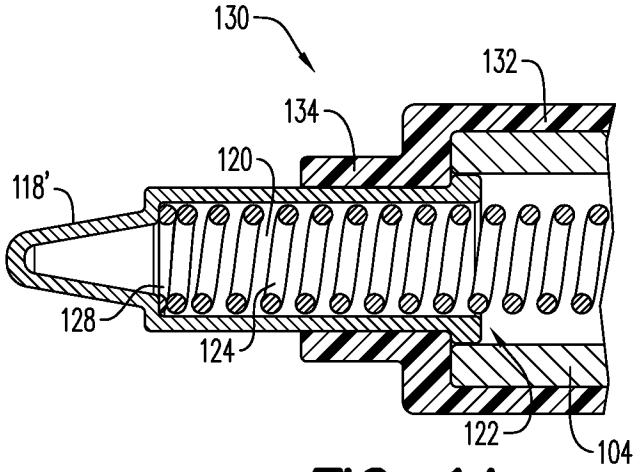
FIG. 1A is a partial cross section view of a bulkhead according to an exemplary embodiment.

The first electrical contact 118 may be formed of an electrically conductive material, and may include a first contact hollow interior 120 and a first open end 122. Similarly, the second electrical contact 136 may be formed of an electrically conductive material, and may include a second contact hollow interior 138 and a second open end 140. The first electrical contact 118 and the second electrical contact 136 may be formed by a deep drawn molding method or other suitable method that allows formation of a hollow part. The first electrical contact 118 and the second electrical contact 136 may be formed in any size, shape, or dimension suitable for providing an electrical connection to an adjacent electrically conductive component. For example, with reference to FIG. 1, the first electrical contact 118 may be formed with a flattened hollow tip. In an exemplary embodiment shown in FIG. 1A, the first electrical contact 118' may be formed with a pointed hollow tip. However, it will be understood that the size, shape, or dimension of the first electrical contact 118 and the second electrical contact 136 are not limited to these examples, and that other sizes, shapes, or dimensions are possible.

The first spring 124 may be formed of an electrically conductive material. A first spring end 126 of the first spring 124 may be in contact with the first contact surface 106 of the fixed body 104. The first spring 124 may extend through the first open end 122 of the first electrical contact 118 such that a second spring end 128 of the first spring 124 may be in contact with the first electrical contact 118 within the first contact hollow interior 120.

Similarly, the second spring 142 may be formed of an electrically conductive material. A third spring end 144 of the second spring 142 may be in contact with the second contact surface 110 of the fixed body 104. The second spring 142 may extend through the second open end 140 of the second electrical contact 136 such that a fourth spring end 146 of the second spring 142 may be in contact with the second electrical contact 136 within the second contact hollow interior 138. In this way, the first electrical contact 118, the first spring 124, the fixed body 104, the second spring 142, and the second electrical contact 136 may be in mutual electrical communication with each other.

Figure 2:
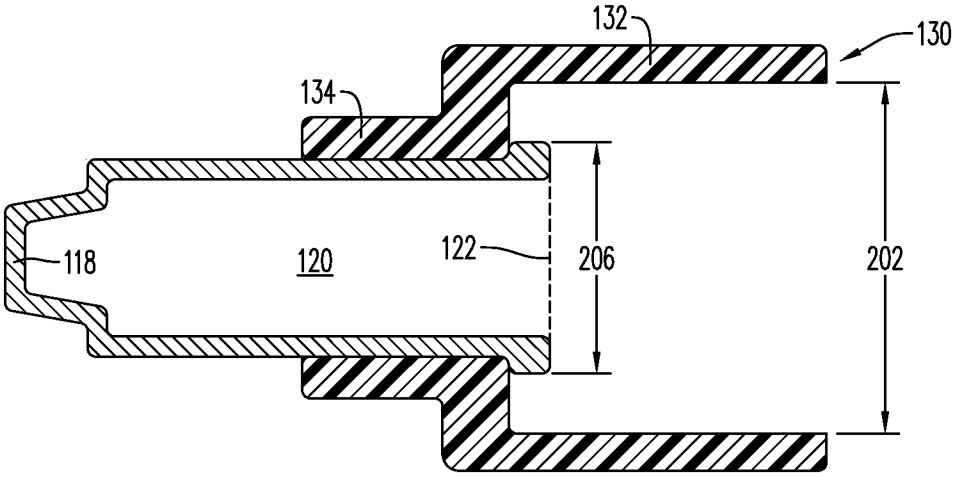
FIG. 2 is a cross section view of a first cover and a first electrical contact according to an exemplary embodiment.
Figure 3:
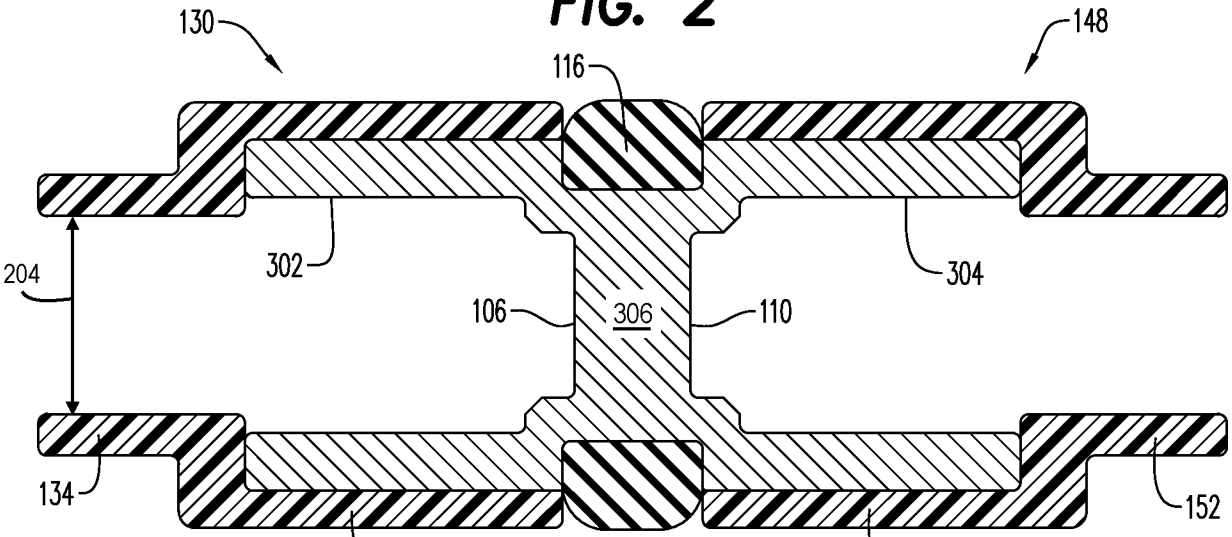
FIG. 3 is a cross section view of a first cover, a second cover, and a fixed body according to an exemplary embodiment.

The first cover 130 may include a first large region 132 having a first large region inner diameter 202 and a first small region 134 having a first small region inner diameter 204 (see FIG. 3). As further seen in FIG. 2, the first large region inner diameter 202 may be larger than the first small region inner diameter 204. The first cover 130 may be formed of an electrically non-conductive material such as plastic, ceramic, glass, wood, thermoplastic, or other suitable non-conductive material. In an aspect, the first cover 130 may be formed of a polyamide material, for example, Polyamide 6, Nylon 6, or polycaprolactam (PA6).

Similarly, the second cover 148 may include a second large region 150 having a second large region inner diameter and a second small region 152 having a second small region inner diameter. Similar to the relationship illustrated between the first large region inner diameter 202 and the first small region inner diameter 204 in FIGS. 2 and 3, the second large region inner diameter may be larger than the second small region inner diameter. The second cover 148 may be formed of an electrically non-conductive material such as plastic, ceramic, glass, wood, thermoplastic, or other suitable non-conductive material. In an aspect, the second cover 148 may be formed of a polyamide material, for example, Polyamide 6, Nylon 6, or polycaprolactam (PA6).

The first cover 130 and the second cover 148 may be fixed to the fixed body 104. For example, the first cover 130 and the second cover 148 may be press fit to the fixed body 104, attached to the fixed body 104 via a glue, epoxy, or other adhesive, or threadedly engaged with the fixed body 104 via mutually complementary threads. However, it will be understood that the affixation of the first cover 130 and the second cover 148 to the fixed body 104 are not limited to these examples, and that other methods of affixation are possible.

FIG. 1 further shows that there may be a gap 154 between the first cover 130 and the second cover 148 through which the seal element 116 may protrude. In this way, the first cover 130 and the second cover 148 may prevent flow or movement of the seal element 116. In other words, the first cover 130 and the second cover 148 may help to maintain the seal element 116 in the proper position.

It will be understood that the depiction of the first cover 130 and the second cover 148 is not intended to be limited in terms of the composition or number of parts in the structure(s) surrounding the fixed body 104. For example, the first cover 130 and the second cover 148 may be collectively referred to as a single cover. Alternatively, the first cover 130 and the second cover 148 may be replaced by a single cover. In this case, the seal element 116 may protrude through the gap 154 in the cover. Alternatively still, there may be more than two covers in an exemplary embodiment where there is more than one seal element 116.

The fixed body 104, the first electrical contact 118, and the first spring 124 may be inserted through the first cover 130 such that the first electrical contact 118 protrudes through the first small region 134 of the first cover 130. Further, a portion of the first large region 132 may surround a first fixed body portion 302 of the fixed body 104 (see FIG. 3). Similarly, the fixed body 104, the second electrical contact 136, and the second spring 142 may be inserted through the second cover 148 such that the second electrical contact 136 protrudes through the second small region 152 of the second cover 148. Further, a portion of the second large region 150 may surround a second fixed body portion 304 of the fixed body 104 (see FIG. 3). A third fixed body portion 306 of the fixed body 104 may be provided between the first fixed body portion 302 and the second fixed body portion 304. The third fixed body portion 306 may be formed of a solid piece of electrically conductive material configured to provide an electrical connection between the first contact surface 106 and the second contact surface 110. In an aspect, the seal element 116 may be provided on the exterior fixed body surface 114 defined by the third fixed body portion 306.

The first electrical contact 118 may have a first contact maximum outer diameter 206. The first contact maximum outer diameter 206 may be larger than the first small region inner diameter 204. Thus, the first electrical contact 118 may be retained within the first cover 130. Similarly, the second electrical contact 136 may have a second contact maximum outer diameter. Similar to the relationship between the first small region inner diameter 204 and the first contact maximum outer diameter 206 shown in FIG. 2, the second contact maximum outer diameter may be larger than the second small region inner diameter. Thus, the second electrical contact 136 may be retained within the second cover 148. In an aspect, the first contact maximum outer diameter 206 may be the same as or different (i.e., smaller or larger) than the second contact maximum outer diameter.

Figure 4B:
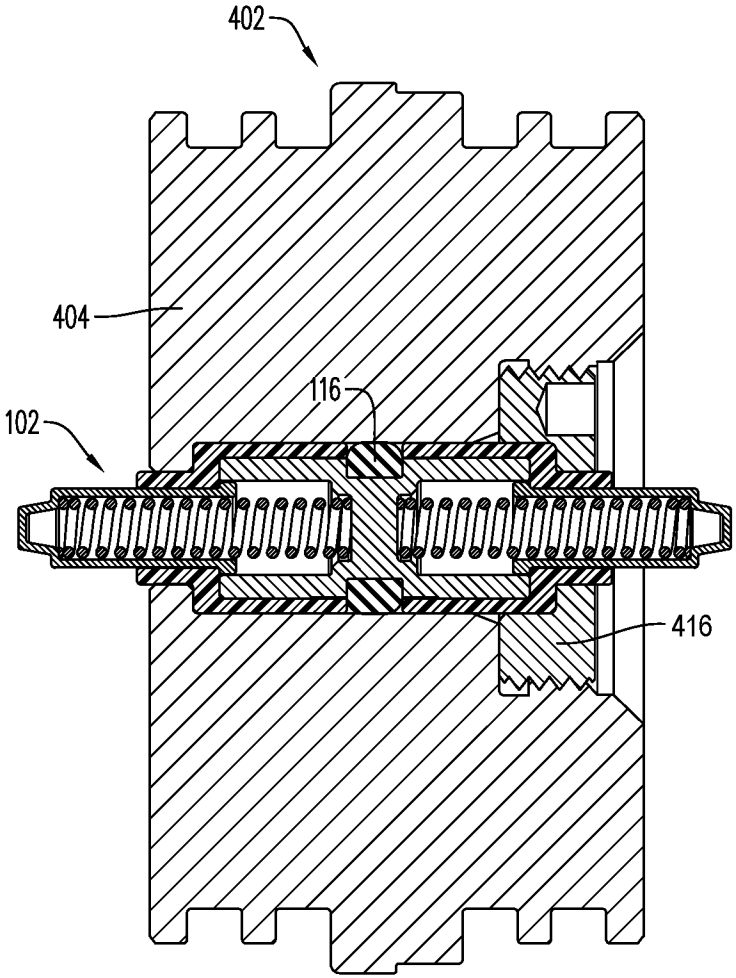
FIG. 4B is a cross section view of a tandem seal adapter and bulkhead according to an exemplary embodiment.
Figure 4A:
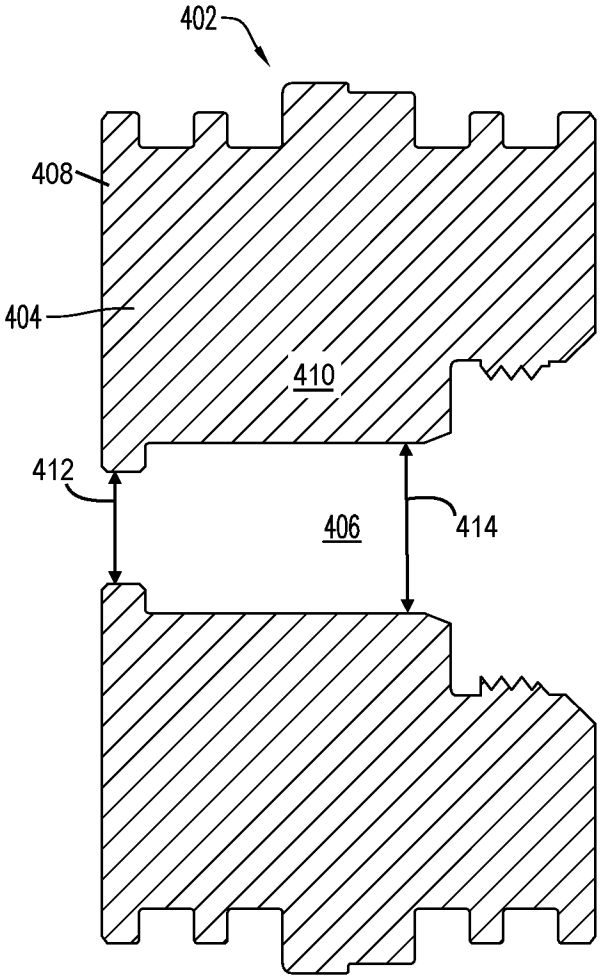
FIG. 4A is a cross section view of a tandem seal adapter according to an exemplary embodiment.

FIG. 4A and FIG. 4B show an exemplary embodiment of a tandem seal adapter (TSA) 402. The tandem seal adapter 402 may include a TSA body 404 and a bore 406 extending through the TSA body 404. As seen in FIG. 4B, the bulkhead 102 may be provided within the bore 406. The TSA body 404 may include a first body portion 408 having a first bore inner diameter 412 and a second body portion 410 having a second bore inner diameter 414. The second bore inner diameter 414 may be larger than the first bore inner diameter 412. The first large region 132 of the first cover 130 and the second large region 150 of the second cover 148 (see FIG. 3) may have a cover maximum outer diameter that is larger than the first bore inner diameter 412. Thus, the bulkhead 102 may be retained within the TSA body 404. The seal element 116 of the bulkhead 102 may be in contact with the TSA body 404 (i.e., with the second body portion 410) in order to form a seal that prevents transfer of fluid and/or pressure through the tandem seal adapter 402. The bulkhead 102 may be secured in the tandem seal adapter 402 via a retainer nut 416 or other suitable structure.

Figure 5:
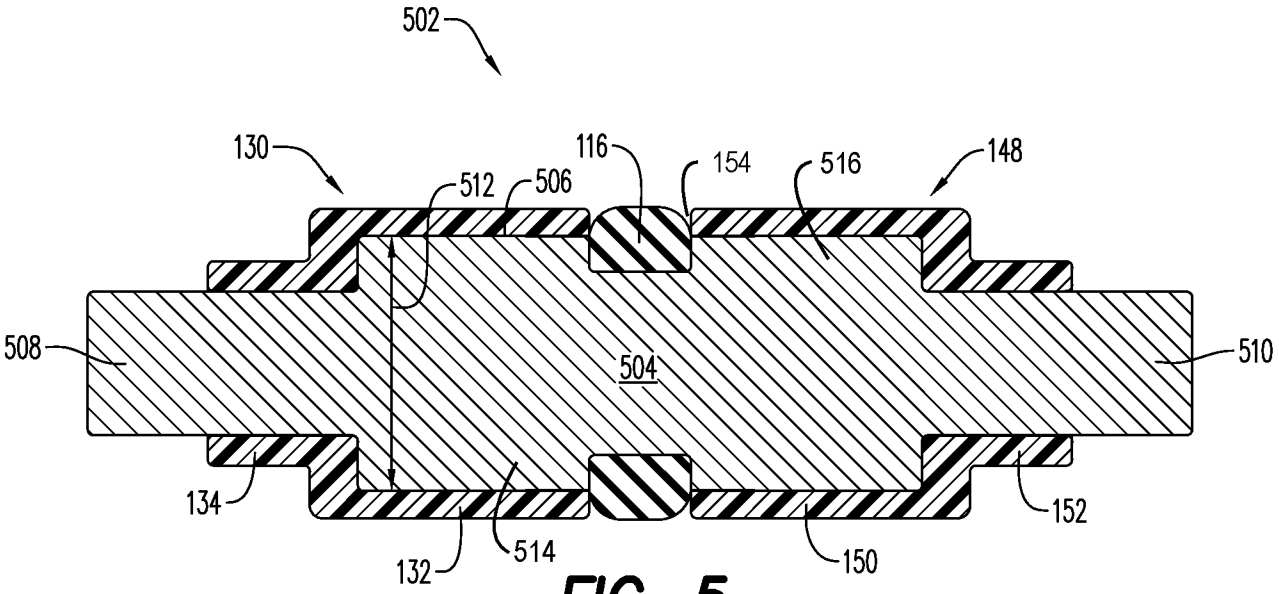
FIG. 5 is a cross section view of a bulkhead according to an exemplary embodiment

FIG. 5 shows another exemplary embodiment of a bulkhead 502. The bulkhead 502 may include a fixed body 504, the seal element 116, the first cover 130, and the second cover 148. The fixed body 504 may be formed of a conductive material as an integral and monolithic piece extending through the bulkhead 502. The fixed body 504 may include an exterior fixed body surface 506, and the seal element 116 may be provided on the exterior fixed body surface 506 in a gap 154 formed between the first cover 130 and the second cover 148. The fixed body 504 may further include a first contact protrusion 508 that extends through the first small region 134 of the first cover 130 and a second contact protrusion 510 that extends through the second small region 152 of the second cover 148. A portion of the first large region 132 of the first cover 130 may surround a first fixed body portion 514 of the fixed body 504, and a portion of the second large region 150 of the second cover 148 may surround a second fixed body portion 516 of the fixed body 504. The fixed body 504 may have a fixed body maximum diameter 512 that is larger than the first small region inner diameter 204 (see FIG. 2) and the second small region inner diameter.

In an alternative perspective, the fixed body 504, the first contact protrusion 508, and the second contact protrusion 510 may be considered as separate components, i.e., as a first electrical contact, the fixed body 504, and a second electrical contact, all in mutual electrical communication with each other, and providing electrical communication through the bulkhead 502.

Figure 6:
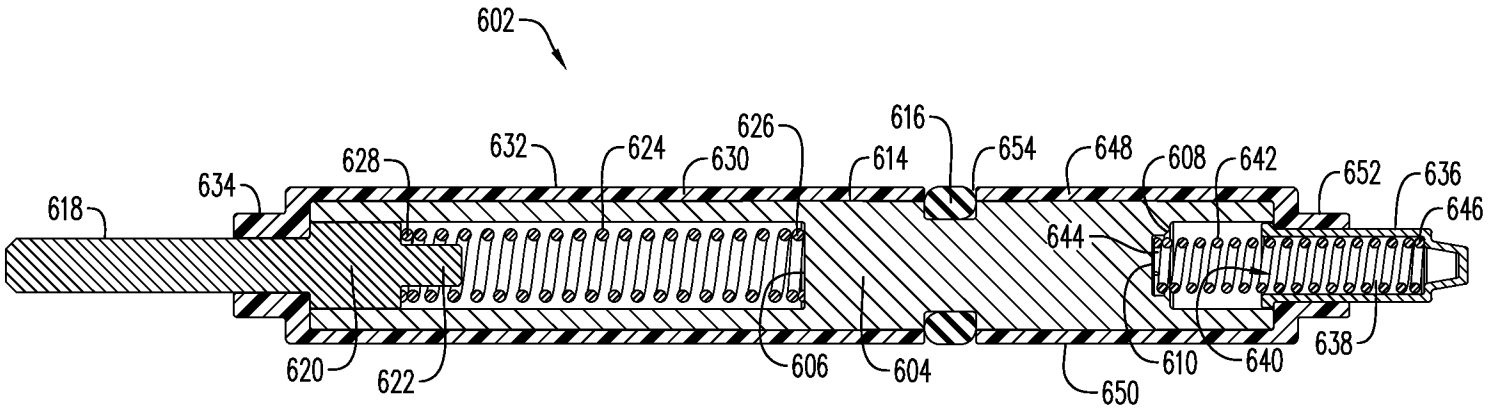
FIG. 6 is a cross section view of a bulkhead according to an exemplary embodiment.

FIG. 6 shows an exemplary embodiment of a bulkhead 602. The bulkhead 602 may include a fixed body 604, a seal element 616, a first electrical contact 618, a second electrical contact 636, a first spring 624, a second spring 642, and a cover (i.e., a first cover 630, and a second cover 648).

The fixed body 604 may be formed of an electrically conductive material and may include a first contact surface 606, a second contact surface 610 opposite to the first contact surface 606, and an exterior fixed body surface 614. The seal element 616 may be provided on the exterior fixed body surface 614. As shown in the exemplary embodiment, the first contact surface 606 may be provided as a flat, planar surface with no adjacent chamfering or curvature such that the first contact surface 606 is perpendicular to a neighboring inner wall of the fixed body 604. A chamfered edge 608 may be provided adjacent to the second contact surface 610. In an aspect, one or each of the first contact surface 606 and the second contact surface 610 may be formed as a flat, planar surface. Alternatively, a chamfered edge may be formed adjacent to the first contact surface 606. In a further embodiment, one or each of the first contact surface 606 and the second contact surface 610 may be rounded or curved.

The first electrical contact 618 may be formed of an electrically conductive material, and may be formed as a solid, monolithic component. The first electrical contact 618 may be formed by machining processes such as computerized numerical control (CNC) machining, 3-D milling, or other metal machine processes. The first electrical contact 618 may include a first contact body 620 and a first contact end 622 and be configured such that the first electrical contact 618, the first spring 624, and the fixed body 604 are in mutual electrical communication with each other.

The first spring 624 may be formed of an electrically conductive material. A first spring end 626 of the first spring 624 may be in contact with the first contact surface 606 of the fixed body 604. The first spring 624 may be positioned to receive and retain the first contact end 622 of the first electrical contact 618 within an interior space of the first spring 624 such that a second spring end 628 of the first spring 624 may be in contact with the first electrical contact 618 within an interior space of the fixed body 604. It will be understood that the depiction of the first electrical contact 618 is not intended to be limited in terms of the size, shape, or dimension of the first electrical contact 618. In an alternative embodiment, for example, the first contact end 622 may be a flat surface, or may be formed with an opening in which the second spring end 628 is received. However, it will be understood that the size, shape, or dimension of the first electrical contact 618 is not limited to these examples, and that other sizes, shapes, or dimensions are possible.

The second electrical contact 636 may be formed of an electrically conductive material, and may include a second contact hollow interior 638 and a second contact open end 640. The second electrical contact 636 may be formed by a deep drawn molding method or other suitable method that allows formation of a hollow part.

The second spring 642 may be formed of an electrically conductive material. A third spring end 644 of the second spring 642 may be in contact with the second contact surface 610 of the fixed body 604. The second spring 642 may extend through the second contact open end 640 of the second electrical contact 636 such that a fourth spring end 646 of the second spring 642 may be in contact with the second electrical contact 636 within the second contact hollow interior 638. In this way, the first electrical contact 618, the first spring 624, the fixed body 604, the second spring 642, and the second electrical contact 636 may be in mutual electrical communication with each other.

The first cover 630 and the second cover 648 may be fixed to the fixed body 604. For example, the first cover 630 and the second cover 648 may be press fit to the fixed body 604, attached to the fixed body 604 via a glue, epoxy, or other adhesive, or threadedly engaged with the fixed body 604 via mutually complementary threads. However, it will be understood that the affixation of the first cover 630 and the second cover 648 to the fixed body 604 are not limited to these examples, and that other methods of affixation are possible.

FIG. 6 further shows that there may be a gap 654 between the first cover 630 and the second cover 648 through which the seal element 616 may protrude. In this way, the first cover 630 and the second cover 648 may prevent flow or movement of the seal element 616. In other words, the first cover 630 and the second cover 648 may help to maintain the seal element 616 in the proper position.

It will be understood that the depiction of the first cover 630 and the second cover 648 is not intended to be limited in terms of the composition or number of parts in the structure(s) surrounding the fixed body 604. For example, the first cover 630 and the second cover 648 may be collectively referred to as a single cover. Alternatively, the first cover 630 and the second cover 648 may be replaced by a single cover. In this case, the seal element 616 may protrude through the gap 654 in the cover. Alternatively still, there may be more than two covers in an exemplary embodiment where there is more than one seal element 616.

Figure 7B:
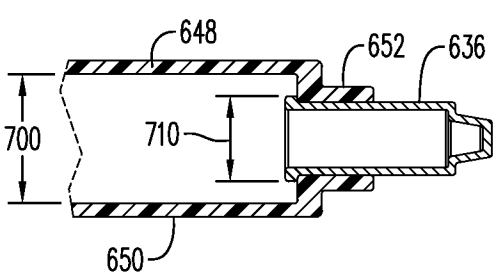
FIG. 7B is a partial cross section view of a second cover and a second electrical contact according to an exemplary embodiment.
Figure 7A:
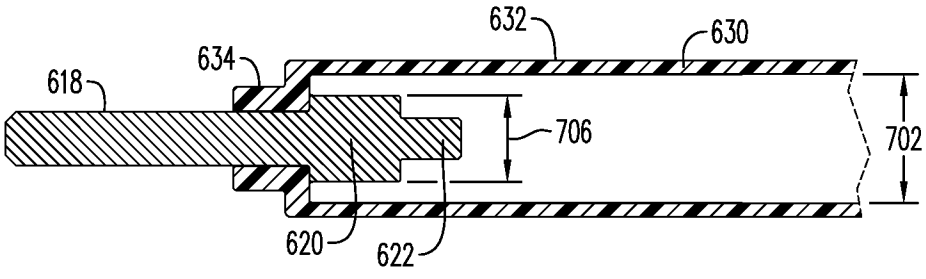
FIG. 7A is a partial cross section view of a first cover and a first electrical contact according to an exemplary embodiment.
Figure 8:
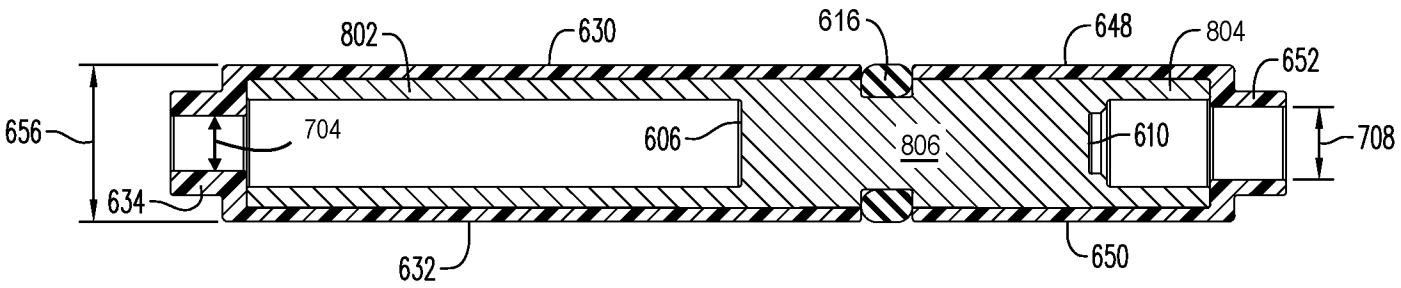
FIG. 8 is a cross section view of a first cover, a second cover, and a fixed body according to an exemplary embodiment.

With reference to FIG. 7A, the first cover 630 may include a first large region 632 having a first large region inner diameter 702 and a first small region 634 having a first small region inner diameter 704 (see FIG. 8). The first large region inner diameter 702 may be larger than the first small region inner diameter 704. The first cover 630 may be formed of an electrically non-conductive material such as plastic, ceramic, glass, wood, thermoplastic, or other suitable non-conductive material. In an aspect, the first cover 630 may be formed of a polyamide material, for example, Polyamide 6, Nylon 6, or polycaprolactam (PA6).

Similarly, with reference to FIG. 7B, the second cover 648 may include a second large region 650 having a second large region inner diameter 700 and a second small region 652 having a second small region inner diameter 708 (see FIG. 8). Similar to the relationship illustrated between the first large region inner diameter 702 and the first small region inner diameter 704 in FIGS. 7A and 8, the second large region inner diameter 700 may be larger than the second small region inner diameter 708. The second cover 648 may be formed of an electrically non-conductive material such as plastic, ceramic, glass, wood, thermoplastic, or other suitable non-conductive material. In an aspect, the second cover 648 may be formed of a polyamide material, for example, Polyamide 6, Nylon 6, or polycaprolactam (PA6). In an aspect, the first large region inner diameter 702 may be the same as or different (i.e., smaller or larger) than the second large region inner diameter 700. The first small region inner diameter 704 may be the same as or different (i.e., smaller or larger) than the second small region inner diameter 708.

The first electrical contact 618 may have a first contact maximum outer diameter 706. The first contact maximum outer diameter 706 may be larger than the first small region inner diameter 704. Thus, the first electrical contact 618 may be retained within the first cover 630. Similarly, the second electrical contact 636 may have a second contact maximum outer diameter 710. Similar to the relationship between the first small region inner diameter 704 and the first contact maximum outer diameter 706, the second contact maximum outer diameter 710 may be larger than the second small region inner diameter 708. Thus, the second electrical contact 636 may be retained within the second cover 648. In an aspect, the first contact maximum outer diameter 706 may be the same as or different (i.e., smaller or larger) than the second contact maximum outer diameter 710.

The fixed body 604, the first electrical contact 618, and the first spring 624 may be inserted through the first cover 630 such that the first electrical contact 618 protrudes through the first small region 634 on a first end of the cover 630. Further, a portion of the first large region 632 may surround a first fixed body portion 802 of the fixed body 604 (see FIG. 8). Similarly, the fixed body 604, the second electrical contact 636, and the second spring 642 may be inserted through the second cover 648 such that the second electrical contact 636 protrudes through the second small region 652 on a second end of the cover 648. Further, a portion of the second large region 650 may surround a second fixed body portion 804 of the fixed body 604 (see FIG. 8). A third fixed body portion 806 of the fixed body 604 may be provided between the first fixed body portion 802 and the second fixed body portion 804. The third fixed body portion 806 may be formed of a solid piece of electrically conductive material configured to provide an electrical connection between the first contact surface 606 and the second contact surface 610. The sealing element 616 may be provided on the exterior fixed body surface 614 defined by the third fixed body portion 806.

Figure 9A:
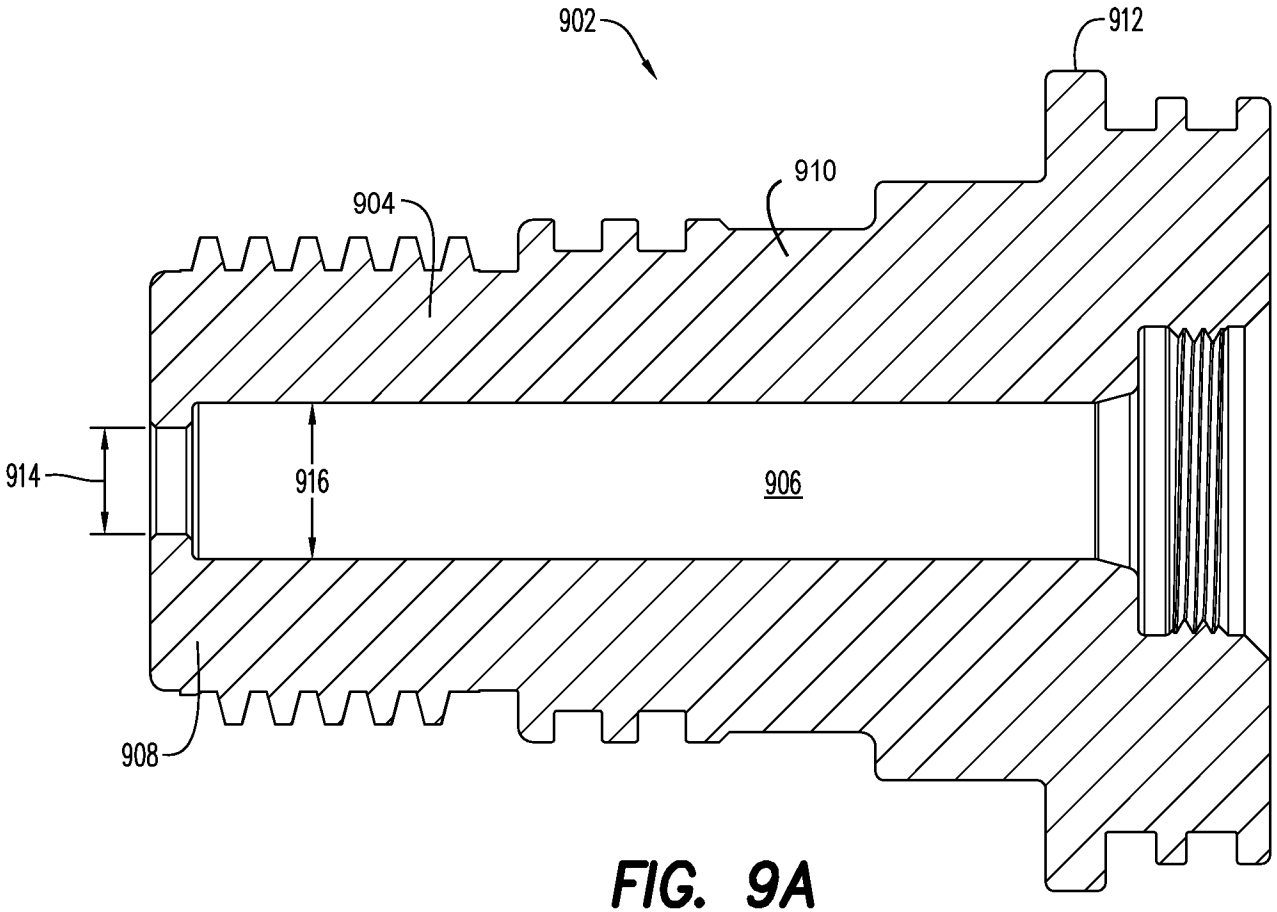
FIG. 9A is a cross section view of a top connector tandem seal adapter according to an exemplary embodiment.
Figure 9B:
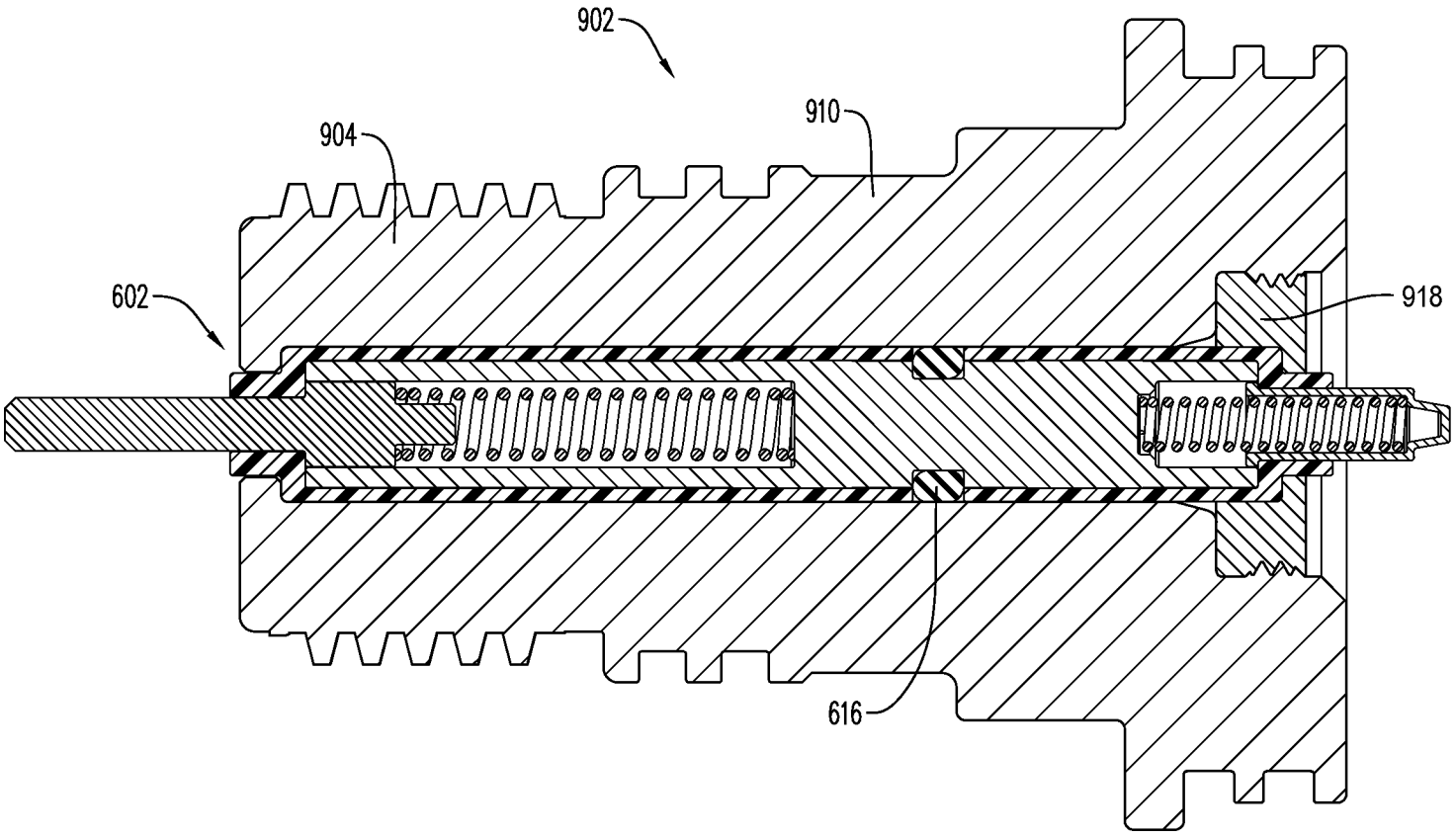
FIG. 9B is a cross section view of a top connector tandem seal adapter and bulkhead according to an exemplary embodiment.

FIG. 9A and FIG. 9B show an exemplary embodiment of a top connector tandem seal adapter (TSA) 902 that may be used as a top connector for electrical connection of a perforating gun to a tool string. The TSA or top connector 902 may include a TSA body 904 and a bore 906 extending through the TSA body 904. As seen in FIG. 9B, the bulkhead 602 may be provided within the bore 906. The TSA body 904 may include a first body portion 908 having a first bore inner diameter 914 and a second body portion 910 having a second bore inner diameter 916. The second bore inner diameter 916 may be larger than the first bore inner diameter 914. The seal element 616 of the bulkhead 602 may be in contact with the TSA body 904 (i.e., with the second body portion 910) in order to form a seal that prevents transfer of fluid and/or pressure through the tandem seal adapter 902.

The first cover 630 and the second cover 648 may have a cover maximum outer diameter 656 (see FIG. 8). The cover maximum outer diameter 656 may be larger than the first bore inner diameter 914. Thus, the bulkhead 602 may be retained within the TSA body 904. The bulkhead 602 may be secured in the tandem seal adapter 902 via a retainer nut 918 or other suitable structure.

Figure 10:
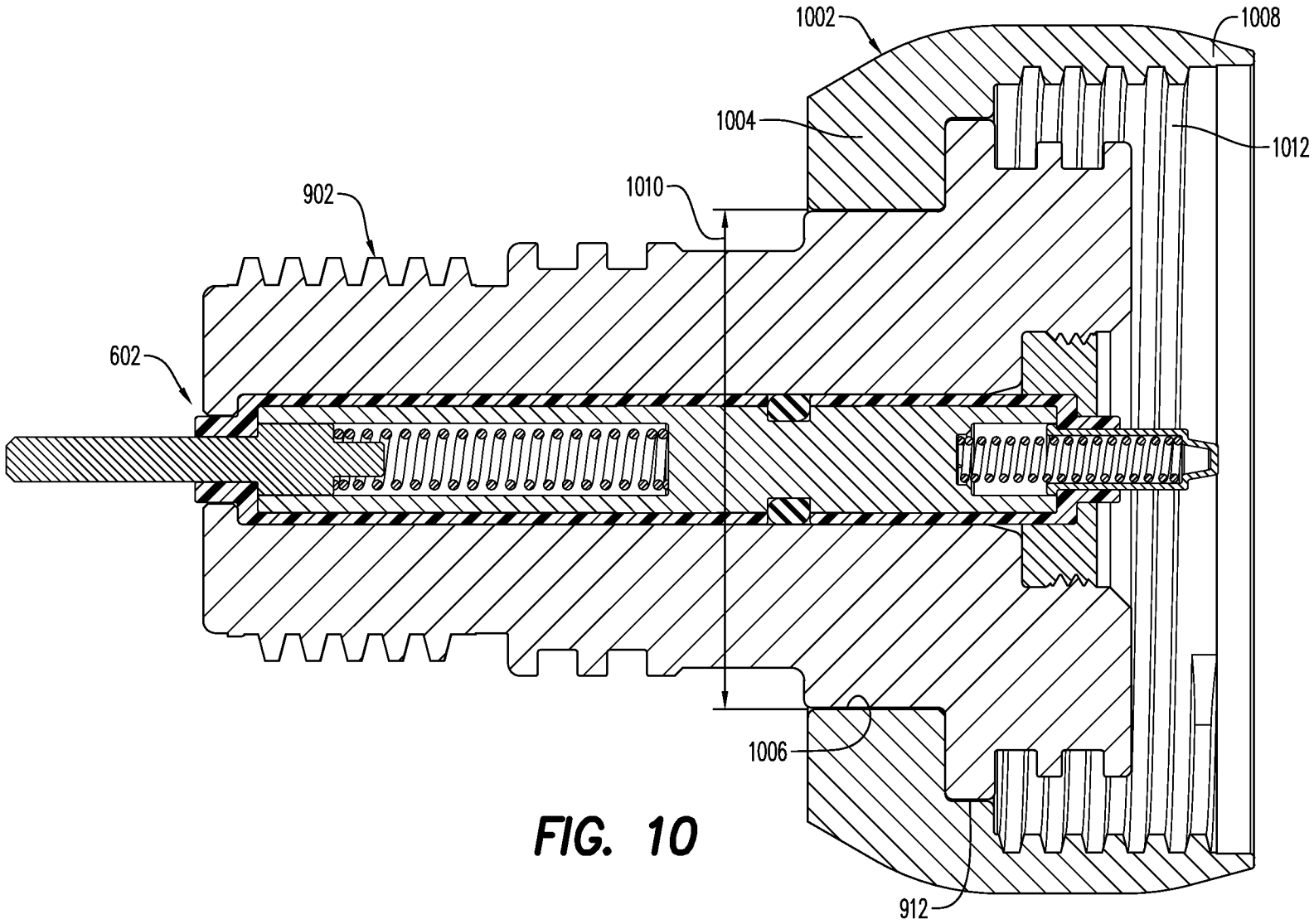
FIG. 10 is a cross section view of a collar, a top connector tandem seal adapter, and a bulkhead according to an exemplary embodiment.

FIG. 10 shows an exemplary embodiment of a bulkhead 602 secured within a tandem seal adapter 902 that is in turn retained in a collar 1002. The collar 1002 may include a collar body 1004, a collar bore 1006 extending through collar body 1004, and a collar open end 1008. The TSA body 904 may include a maximum outer diameter portion 912 (see FIG. 9A) that is larger than a collar inner diameter 1010 defined by the collar bore 1006. Thus, the tandem seal adapter 902 is retained within the collar 1002. In an aspect, the second electrical contact 636 may be positioned adjacent to the collar open end 1008 for electrical contact and connection to an adjacent electrically conductive component. The collar open end 1008 may be configured for connection to an adjacent wireline tool, such as a wireline release tool. In an aspect, the collar open end 1008 may include a threaded interior portion 1012 for engagement with an adjacent wireline tool via mutually complementary threads.

The Figures described above illustrate embodiments with one seal element 116, 616. In some embodiments, there will be one and only one seal element 116, 616, with no other seal elements provided elsewhere on the bulkhead 102, 502, 602. Alternatively, an exemplary embodiment may have more than one seal element 116, 616, provided on the exterior fixed body surface 114, 506, 614 of the fixed body 104, 504, 604. An exemplary embodiment with one and only one seal element 116, 616 may be advantageous in that it can reduce manufacturing costs due to the reduced number of components compared to devices with multiple seal elements. Additionally, using one and only one seal element 116, 616 reduces the possible points of failure from a hydraulic sealing point of view.

The embodiments described above may provide a number of benefits over conventional devices. For example, by placing the seal element 116, 616 directly on the fixed body 104, 604 and protruding through the gap 154, 654, the total number of required sealing elements can be reduced, as compared with conventional devices in which sealing elements may be provided on both an interior conductive body and an exterior bulkhead body. This may help to reduce the overall length of the bulkhead 102, 602, as well as reduce manufacturing costs.

Additionally, because in an exemplary embodiment the first cover 130 and the second cover 148 may not be directly involved with the sealing function of the bulkhead 102, a wider range of materials can be used in making the first cover 130 and the second cover 148. This allows for the selection of cost-effective materials to reduce the overall cost of the bulkhead 102.

The embodiments provided above may be used for electrical connection to various wireline tools to provide a wireline tool string including a bulkhead 102, 502, 602 and tandem seal adapter 402, and/or top connector tandem seal adapter 902, in which a first wireline tool is electrically connected to the first electrical contact 118, 508, 618 and a second wireline tool is electrically connected to the second electrical contact 136, 510, 636. In an aspect, the solid first electrical contact 618 may formed of a size, shape, and dimension that conforms to an industry standard shape, size, or dimension that is well-known for electrical connection with a range of commercially available wellbore tools. The bulkhead 602 may be provided in a wireline tool string top connector tandem seal adapter (e.g., 902) for electrical connection to, for example, a casing collar locator (CCL). The first electrical contact 618 may be oriented up-hole in a tool string to connect to an adjacent up-hole tool, while the second electrical contact 636 may be oriented to electrically connect to a detonator head or another adjacent down-hole tool.

Further, with respect to the first electrical contact 118 and the second electrical contact 136 of the bulkhead 102, the first contact hollow interior 120 provided in the first electrical contact 118 and the second contact hollow interior 138 provided in the second electrical contact 136 allow for a longer travel distance of the first spring 124 and the second spring 142. This increases the dampening effect of the first spring 124 and the second spring 142, especially after the firing of a perforating gun. Additionally, manufacturing costs can be reduced because of the reduced costs associated with the deep drawn method used for making the first electrical contact 118 and the second electrical contact 136. The hollow structure of the first electrical contact 118 and the second electrical contact 136 due to the deep drawn material or non-solid material may allow for a significant collapsible or deformable zone around the first electrical contact 118 and the second electrical contact 136. This may provide significant advantages in that shock impact and potential mechanical damage to a detonator head or other contacting components can be reduced or eliminated. Further, the first chamfered edge 108 and the second chamfered edge 112 may allow the inner ends of the first electrical contact 118 and the second electrical contact 136 to deform in the case of a shock during the firing of perforation guns, thereby improving a dampening effect.

In some embodiments (e.g., FIG. 1), the profile of the end pin of the first electrical contact 118 and/or the second electrical contact 136 may be flattened. In other embodiments (e.g., FIG. 1A), the profile of the end pin of the first electrical contact and/or the second electrical contact 136 may be pointed. A flattened end pin profile may be advantageous in general applications. A pointed end pin profile may be advantageous in applications in which it is desirable to reduce rotational surface friction by the first electrical contact or the second electrical contact against the opposing electrode in an adjacent component to which the first electrical contact or the second electrical contact is electrically connected. This may include, for example, internally rotating or swiveling self-orienting perforating gun systems.

Further, the first contact protrusion 508 and the second contact protrusion 510 of the bulkhead 502 may be configured for electrical connection to an adjacent wireline tool or component that includes its own respective spring-loaded contact. The solid, non-spring-loaded design of the bulkhead fixed body 504 requires connection to an opposite spring-loaded contact, such as a spring-loaded end plate or spring-loaded detonator, as described in U.S. Pat. No. 10,188,990, which is commonly owned by DynaEnergetics Europe GmbH and incorporated herein by reference.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine," "calculate," and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A bulkhead, comprising:

a fixed body having an exterior fixed body surface, a portion of the exterior fixed body surface being perpendicular to a radius of the fixed body;

a first cover having a first large region having a first large region inner diameter and a first small region having a first small region inner diameter, the first large region inner diameter being larger than the first small region inner diameter;

a second cover having a second large region having a second large region inner diameter and a second small region having a second small region inner diameter, the second large region inner diameter being larger than the second small region inner diameter;

a seal element contacting the portion of the exterior fixed body surface in a gap provided between the first cover and the second cover;

a first electrical contact that extends through the first small region of the first cover; and a second electrical contact that extends through the second small region of the second cover.

2. The bulkhead of claim 1, wherein only one seal element is contacting the exterior fixed body surface.

3. The bulkhead of claim 1, wherein:

the fixed body is formed of a conductive material as an integral and monolithic piece extending through the bulkhead.

4. The bulkhead of claim 1, wherein:

the fixed body has a fixed body maximum diameter; and the seal element is provided at an axial position of the fixed body having a diameter smaller than the fixed body maximum diameter.

5. The bulkhead of claim 1, wherein:

the first cover and the second cover are affixed to the exterior fixed body surface so that the seal element is maintained in position in the gap.

6. The bulkhead of claim 1, wherein:

the first cover and the second cover each compromise a non-conductive material.

7. A tandem seal adapter (TSA), comprising:

a TSA body;

a bore extending through the TSA body;

a bulkhead provided within the bore, the bulkhead comprising:

a fixed body having an exterior fixed body surface, a portion of the exterior fixed body surface being perpendicular to a radius of the fixed body;

a cover provided on the fixed body, wherein the cover comprises:

a first cover having a first large region having a first large region inner diameter and a first small region having a first small region inner diameter, the first large region inner diameter being larger than the first small region inner diameter, and a second cover having a second large region having a second large region inner diameter and a second small region having a second small region inner diameter, the second large region inner diameter being larger than the second small region inner diameter; and a seal element contacting the portion of the exterior fixed body surface in a gap provided between the first cover and the second cover;

a first electrical contact extending through the first small region of the first cover; and a second electrical contact extending through the second small region of the second cover.

8. The TSA of claim 7, wherein:

the seal element of the bulkhead is in contact with the TSA body to form a seal that prevents transfer of fluid and pressure through the TSA.

9. The TSA of claim 7, wherein:

the first electrical contact, the fixed body, and the second electrical contact are in mutual electrical communication.

10. The TSA of claim 7, further comprising:

a collar body; and a collar bore extending through collar body, wherein the TSA body is provided within the collar bore, and wherein the second electrical contact of the bulkhead is positioned adjacent an open end of the collar body for electrical connection to an adjacent wireline tool.

11. The TSA of claim 10, wherein:

the adjacent wireline tool is one of a wireline release tool and a spring-loaded wireline tool.

12. The TSA of claim 7, wherein:

at least one of the first electrical contact and the second electrical contact comprises a contact body comprising a solid piece of material.

13. The TSA of claim 7, wherein:

the first electrical contact, the fixed body, and the second electrical contact are together formed of a conductive material as an integral and monolithic piece extending through the bulkhead.

14. The TSA of claim 7, wherein:

only one seal element is contacting the exterior fixed body surface.

15. The TSA of claim 7, wherein:

the first cover and the second cover are affixed to the exterior fixed body surface so that the seal element is maintained in position in the gap.

16. A wireline tool string, comprising:

a tandem seal adapter (TSA) body;

a bore extending through the TSA body;

a bulkhead provided within the bore, the bulkhead comprising:

a fixed body having an exterior fixed body surface, a portion of the exterior fixed body surface being perpendicular to a radius of the fixed body;

a cover provided on the fixed body, wherein the cover comprises:

a first cover having a first large region having a first large region inner diameter and a first small region having a first small region inner diameter, the first large region inner diameter being larger than the first small region inner diameter, and a second cover having a first large region having a first large region inner diameter and a first small region having a first small region inner diameter, the first large region inner diameter being larger than the first small region inner diameter;

a first electrical contact extending through the first small region of the first cover; and a second electrical contact extending through the second small region of the second cover;

a first wireline tool connected to the TSA body; and a seal element contacting the portion of the exterior fixed body surface in a gap provided between the first cover and the second cover.

17. The wireline tool string of claim 16, further comprising:

a second wireline tool electrically connected to the second electrical contact.

18. The wireline tool string of claim 16, wherein:

the first wireline tool is a spring-loaded wireline tool.

19. The wireline tool string of claim 16, wherein:

only one seal element is contacting the exterior circumferential fixed body surface.

* * * * *